US012662230B2

(12) United States Patent
Ueno

(10) Patent No.: US 12,662,230 B2
(45) Date of Patent: Jun. 23, 2026

(54) SHIP CONTROL DEVICE, A SHIP CONTROL METHOD, AND A SHIP CONTROL PROGRAM

(71) Applicant: FURUNO ELECTRIC CO., LTD., Hyogo (JP)

(72) Inventor: Hideki Ueno, Takarazuka (JP)

(73) Assignee: FURUNO ELECTRIC COMPANY LIMITED, Hyogo (JP)

( * ) Notice: Subject to any disclaimer, the term of this patent is extended or adjusted under 35 U.S.C. 154(b) by 34 days.

(21) Appl. No.: 18/737,914

(22) Filed: Jun. 7, 2024

(65) Prior Publication Data

US 2025/0002132 A1 Jan. 2, 2025

(30) Foreign Application Priority Data

Jun. 29, 2023 (JP) ..... 2023-106991

(51) Int. Cl.
*B63H 25/42* (2006.01)
*B63H 25/04* (2006.01)
*B63H 25/02* (2006.01)

(52) U.S. Cl.
CPC ..... *B63H 25/42* (2013.01); *B63H 25/04* (2013.01); *B63H 2025/026* (2013.01)

(58) Field of Classification Search
CPC .. B63H 25/42; B63H 25/04; B63H 2025/026; B63H 21/21; B63H 21/213; B63H 25/02
See application file for complete search history.

(56) References Cited

U.S. PATENT DOCUMENTS

| | | | | |
|---|---|---|---|---|
| 9,248,898 | B1 * | 2/2016 | Kirchhoff | B63H 25/42 |
| 10,780,967 | B2 * | 9/2020 | Clarke | B63H 23/06 |
| 12,269,569 | B2 * | 4/2025 | Wingren | B63H 25/02 |
| 2015/0089427 | A1 * | 3/2015 | Akuzawa | G05D 1/0206 715/771 |
| 2019/0118922 | A1 * | 4/2019 | Mcginley | B63H 25/42 |
| 2019/0155287 | A1 * | 5/2019 | Arbuckle | G08G 3/02 |
| 2020/0140051 | A1 * | 5/2020 | Derginer | G05D 1/0875 |
| 2022/0169352 | A1 * | 6/2022 | Ikegaya | B63H 25/38 |

(Continued)

FOREIGN PATENT DOCUMENTS

| | | | |
|---|---|---|---|
| JP | 2022085659 | A | 6/2022 |
| JP | 2022088152 | A | 6/2022 |
| JP | 2022139744 | A | 9/2022 |

*Primary Examiner* — Abdalla A Khaled
(74) *Attorney, Agent, or Firm* — Studebaker Brackett PLLC

(57) ABSTRACT

A ship control device is provided with an input unit capable of acquiring operation inputs from each of a first operator used in a low-speed navigation control mode and a second operator used in a high speed navigation control mode, and a control unit for determining a target direction and a throttle opening in the direction control at the time of navigation based on the operation inputs acquired in the input unit. The low-speed navigation control mode has a manual operation control mode by the operation of the first operator and an automatic navigation control mode for holding a direction or a throttle opening using the target direction. The control unit is provided with a setting unit for setting the target direction and the throttle opening used for automatic navigation based on the operation input to the first operator in the automatic navigation control mode.

17 Claims, 19 Drawing Sheets

(56) References Cited

U.S. PATENT DOCUMENTS

| | | | | |
|---|---|---|---|---|
| 2022/0169357 | A1* | 6/2022 | Tsuchiya | B63H 25/42 |
| 2022/0291688 | A1* | 9/2022 | Afman | G05D 1/0206 |
| 2023/0195118 | A1* | 6/2023 | Singh | B63B 79/15 701/21 |
| 2023/0297110 | A1* | 9/2023 | Afman | G05D 1/0206 701/21 |
| 2024/0034451 | A1* | 2/2024 | Tsuchiya | B63H 25/02 |
| 2024/0118228 | A1* | 4/2024 | Yazaki | B63H 25/04 |
| 2024/0174331 | A1 | 5/2024 | Hara et al. | |

* cited by examiner

FIG. 6A

| x | Shift | Throttle opening [%] |
|---|---|---|
| +100≧x≧+10 | F | Fmax~Fmin |
| +10>x>-10 | N | 0 |
| -10≧x≧-100 | R | Rmin~Rmax |

FIG. 6B

| y | change rate (°/sec.) |
|---|---|
| +100≧y≧+10 | SH (maximum right turning angle) ~0° |
| +10>y>-10 | 0° (dead zone) |
| -10≧y≧-100 | 0° to PH (maximum left turning angle) |

FIG. 7A

| y | change rate (°/sec.) |
|---|---|
| +100 ~ +85 | +5 |
| +85 ~ 0 | +1 |
| 0 ~-85 | -1 |
| -85 ~ -100 | -1 |

FIG. 7B

| z | change rate (°/sec.) |
|---|---|
| +100 ~ +85 | +5 |
| +85 ~ 0 | +1 |
| 0 ~-85 | -1 |
| -85 ~-100 | -5 |

| x | change rate (°/sec.) |
|---|---|
| +100 ~ DB | +5 |
| DB ~ -95 | -5 |
| -95 ~-100 | (AC release) |

FIG. 8

| Range Level | Shift F (%) | Throttle opening [%] |
|---|---|---|
| LOW | 25 ~30 | 30 ~ 40 |
| MIDDLE | 25 ~35 | 30 ~45 |
| HIGH | 25 ~ 40 | 30 ~50 |

FIG. 10

SHIP CONTROL DEVICE, A SHIP CONTROL METHOD, AND A SHIP CONTROL PROGRAM

CROSS-REFERENCE TO RELATED APPLICATION(S)

This application claims priority under 35 U.S.C § 119 to Japanese Patent Application No. 2023-106991, which was filed on Jun. 29, 2023, the entire disclosure of which is hereby incorporated by reference.

TECHNICAL FIELD

The present invention relates to low-speed boat handling control for a ship.

BACKGROUND

Conventionally, various high-speed auto navigation functions have been devised to automatically navigate a predetermined route at a predetermined speed or higher (high speed mode). In addition, unlike automatic navigation there are techniques for manual operation using a steering wheel, a lever and a joystick.

SUMMARY

By the way, in addition to the high-speed navigation shown in the background technology, ship control is sometimes performed at a low speed, such as when a boat arrives at a dock or when a fishing boat is flown. In this case, the joystick may be used to operate the vessel. Automatic navigation is also required when controlling the ship at such a low speed.

However, when performing the automatic navigation at the low speed, it is not possible to easily and intuitively set throttle opening and heading (rudder angle) for the automatic navigation.

Therefore, it is an object of the present invention to easily and intuitively set automatic navigation at low speeds by utilizing a joystick used for low speed operations.

A ship control device is provided with an interface capable of acquiring operation inputs from each of a first operator used in a low speed navigation control mode and a second operator used in a high speed navigation control mode, and a control unit for determining a target direction or a throttle opening in the direction control at the time of navigation based on the operation inputs acquired by the interface. The low-speed navigation control mode has a manual operation control mode by operating the first operator and an automatic navigation control mode for holding a direction or a throttle opening using the target direction. The control unit is provided with a setting unit for setting the target direction or the throttle opening used for automatic navigation based on the operation input to the first operator in the automatic navigation control mode.

In this configuration, the target direction and the throttle opening used for automatic navigation control at low speed are set by the first operator used in a low-speed manual operation control mode. Thus, the first operator used for operation at low speed may be utilized to easily and intuitively configure settings during automatic navigation at low speed.

In the ship control device of the present invention, the first operator includes a joystick and an operation button. Based on the operation input to the operation button, the setting unit switches from the manual operation control mode to the automatic navigation control mode for holding the direction or throttle opening using the target direction when the operation input is given. After switching to the automatic navigation control mode, the setting unit sets the target direction or the throttle opening used for automatic navigation based on the operation input to the joystick satisfying a predetermined condition.

In this configuration, depending on the selection state between the manual operation control mode and the automatic navigation control mode, operation and setting may be performed more reliably using the first operator that is commonly used for these modes.

In the ship control device of the present invention, the first operator includes a joystick, and the joystick acquires operation input by first tilting and twisting of the shaft ship in a port or starboard directions. The setting unit includes a target direction setting unit used for setting a target direction based on the first tilting or twisting.

The target direction is related to the turning (turning) of the ship, and the target direction may be set more intuitively by assigning the first tilting or twisting of the ship in the port or starboard directions to, for example, the adjustment (increase, change) of the target direction.

In the ship control device according to the present invention, after switching to the automatic navigation control mode, the control unit controls the direction by changing the command rudder angle based on the first tilting or twisting of the joystick, and when a stop of the operation input of the first tilting or twisting of the joystick is detected, the heading at this point is acquired. The target direction setting unit sets the heading as the target direction at the stop of the operation of the first tilting or twisting of the joystick.

In this configuration, the ship may be controlled to the direction desired by the user during the automatic navigation control mode. Then, when the ship reaches the desired direction, the heading is set to the subsequent target direction, so that the automatic direction holding to the desired direction may be resumed.

In the ship control device of the present invention, the control unit sets the command rudder angle proportional to the amount of the first tilting or the amount of the twisting.

In this configuration, the user may intuitively set the command rudder angle at the time of the turning.

In the ship control device of the present invention, the control unit sets a first range in which the command rudder angle assigned to the amount of the first tilting or the amount of the twisting gradually increases, and a second range in which the command rudder angle assigned to the amount of the first tilting or the amount of the twisting sharply increases. The control unit sets the range of the amount of the first tilting or the amount of the twisting in the first range to be larger than the range of the amount of the first tilting or the amount of the twisting in the second range.

In this configuration, the relationship between the amount of the first tilting or the amount of the twisting and the command rudder angle may be prepared in a plurality of patterns according to the operating conditions of the ship. Thus, the command rudder angle may be adjusted according to the operating condition.

Further, in the ship control device of the present invention, the first range is a range in which the amount of the first tilting or the amount of the twisting is smaller than the second range.

In this configuration, the command rudder angle may be easily adjusted more finely during direction holding control in which the amount of steering is relatively small, and unexpected rapid steering may be suppressed.

Further, in the ship control device of the present invention, if the first tilting or twisting operation of the joystick has not been acquired for a predetermined time or longer, the stop of the first tilting or twisting operation is detected.

In this configuration, the stop of the first tilting or twisting operation may be realized in a simple manner without requiring any other operator or the like.

In the ship control device of the present invention, the target direction setting unit gives priority to the first tilting rather than the twisting and adopts the first tilting for setting the target direction.

In a situation where the user is gripping the joystick, there is a possibility that the user may twist the joystick unnecessarily. Therefore, by giving priority to the first tilting, the setting of the target direction according to the user's intention may be performed more reliably.

In the ship control device of the present invention, the target direction setting unit is provided with a change rate setting unit for setting the change rate of the target direction based on the amount of the first tilting or the amount of the twisting.

In this configuration, the user may more intuitively set the amount of the change in the target direction.

In the ship control device of the present invention, the target direction setting unit sets the change rate of the target direction by a discrete value.

In this configuration, the user may set the target direction more simply.

In the ship control device of the present invention, the first operator includes a joystick. When the second tilting of the shaft of the joystick in the bow or stern direction of the ship is within a cancel range of the automatic navigation control mode, the controller stops the automatic navigation control mode and switches to the manual operation control mode, or when an operating speed of the first tilting or second tilting exceeds a predetermined speed.

In this configuration, the automatic navigation control mode may be stopped and switched to the manual operation control mode by a simple operation on the joystick.

In the ship control device of the present invention, the first operator acquires an operation input to enable intermittent throttle control. The control unit is provided with an intermittent throttle signal generation unit to generate an intermittent throttle signal having a High level and a Low level when the intermittent throttle control is enabled.

In this configuration, in the low-speed automatic navigation control mode, an intermittent slot capable of realizing a slower navigation may be easily performed.

In the ship control device of the present invention, the first operator acquires an operation input for setting the intermittent throttle control, and the intermittent throttle signal generation unit is provided with an intermittent throttle setting unit for setting at least either the duty ratio or the frequency of the intermittent throttle signal based on the operation input for setting the intermittent throttle.

In this configuration, it is possible to easily set the intermittent slot.

In the ship control device of the present invention, the first operator is provided with a throttle range selection button for selecting from a plurality of candidates a throttle range indicating a range within which the throttle opening may be set by the operation input of the second tilting of the shaft of the joystick in the bow or stern direction of the ship. The control unit is provided with a throttle range setting unit for selecting and setting one throttle range from a plurality of throttle range candidates based on the operation input to the throttle range selection button.

In this configuration, the user may easily select a setting range of the throttle opening in the low-speed manual operation control mode.

In the ship control device of the present invention, the throttle range setting unit sets the forward throttle range and the backward throttle range differently.

In this configuration, the throttle ranges suitable for each of the forward and backward movement may be set individually.

In the ship control device of the present invention, the control unit is provided with a throttle opening adjustment unit for adjusting the throttle opening based on the amount of the twisting that is operated when the second tilting is maximum.

In this configuration, the throttle opening degree may be easily adjusted.

BRIEF DESCRIPTION OF DRAWINGS

The illustrated embodiments of the subject matter will be best understood by reference to the drawings, wherein like parts are designated by like numerals throughout. The following description is intended only by way of example, and simply illustrates certain selected embodiments of devices, systems, and processes that are consistent with the subject matter as claimed herein.

The present disclosure is illustrated by way of example and not by way of limitation in the figures of the accompanying drawings, in which the like reference numerals indicate like elements and in which:

FIG. 6A is a table showing an example of the relationship between the operation input value (x), the shift, and the throttle opening in the manual operation control mode, and FIG. 6B is a table showing an example of the relationship between the operation input value (y) and the command rudder angle in the manual operation control mode.

FIG. 7A is a table showing an example of the relationship between the operation input value (y) in the automatic navigation control mode and the change rate of the target heading in the slow navigation control mode, and FIG. 7B is a table showing an example of the relationship between the operation input value (z) in the automatic navigation control mode and the change rate of the target heading in the slow navigation control mode.

FIG. 8 is a table showing an example of the relationship between the operation input value (x) in the automatic navigation control mode and the change rate of the throttle opening in the slow navigation control mode.

FIG. 10 is a table showing an example of setting the range level of the throttle opening in the manual operation control mode.

DETAILED DESCRIPTION OF THE EMBODIMENTS

Figure 1:
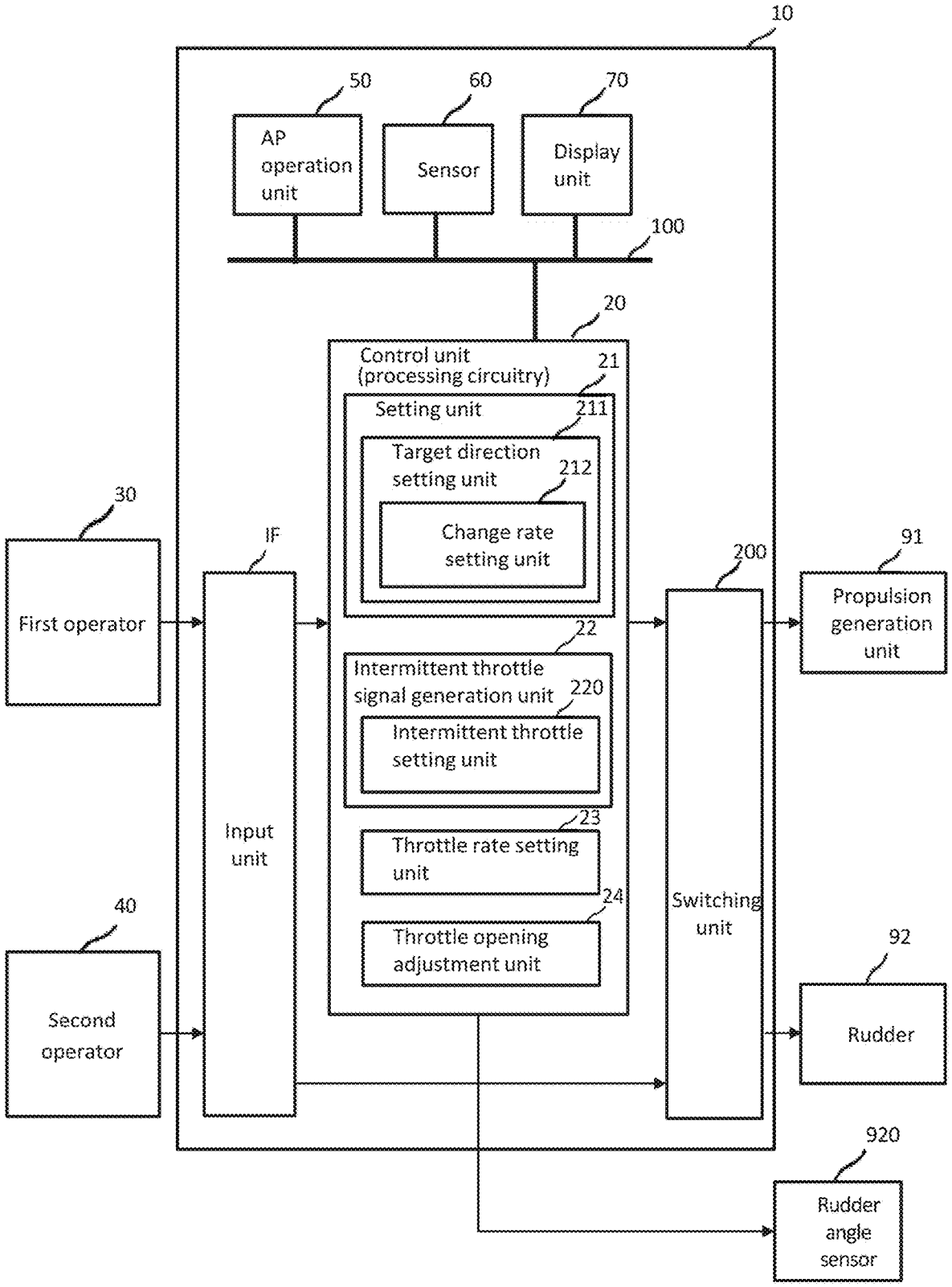
FIG. 1 is a functional block diagram showing an example of a configuration of a ship control system including a ship control device according to an embodiment of the present invention.

Example apparatus are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

A ship control technique (Ship control device, ship control method, and ship control program) according to an embodiment of the present invention will be described with reference to the figures.

FIG. 1 is a functional block diagram showing an example of a configuration of a ship control system including a ship control device according to an embodiment of the present invention.

(Configuration of Ship Control System 1 and Ship Control Device 10)

As shown in FIG. 1, the ship control system 1 includes a ship control device 10, a first operator 30, a second operator 40, a propulsion force generation unit 91, a rudder 92, and a rudder angle sensor 920. The ship control device 10 includes a control unit 20 (which is also referred to as a processing circuitry), an AP operation unit 50, a sensor 60, a display unit 70, a switching unit 200, and an input unit IF. The ship control system 1 is installed on the ship 90 which performs autopilot control (automatic navigation control).

The control unit 20, the AP operation unit 50, the sensor 60, and the display unit 70 are connected to each other by, for example, a data communication network 100 for ships. The control unit 20 is connected to the switching unit 200.

The control unit 20 is realized by, for example, a program for executing a function to be described later, a storage medium for storing the program, and an arithmetic processor for executing the program. The control unit 20 includes a setting unit 21, an intermittent throttle signal generation unit 22, a throttle range setting unit 23, and a throttle opening adjustment unit 24. The setting unit 21 includes a target direction setting unit 211, and the target direction setting unit 211 includes a change rate setting unit 212. The intermittent throttle signal generation unit 22 includes an intermittent throttle setting unit 220. In the following description, the "control unit 20" will be described as a function executing unit except for the specific description of a plurality of functions executed by the control unit 20.

The first operator 30 and the second operator 40 are equipped in the wheelhouse of the ship 90, for example.

The first operator unit 30 is connected to the control unit 20. The first operator 30 includes a joystick and is constituted by a plurality of operation buttons arranged around the joystick. The first operator 30 generates an operation input value based on the operation input from the user (a specific example will be described later) and outputs it to the control unit 20 through an interface IF.

The second operator unit 40 connects to the switching unit 200 through the interface IF. The second operator 40 is, for example, a throttle lever and a steering wheel. The second operator 40 generates an operation input value based on the operation input from the user and outputs it to the switching unit 200 through the interface IF.

The AP operation unit 50 is realized by, for example, a touch panel, a physical button or a switch. The AP operation unit 50 outputs a setting related to high-speed automatic navigation (autopilot) control to the control unit 20.

The sensor 60 measures the position of the ship 90 equipped with the ship control device 10 and the state of the ship such as the heading and the ship speed, and outputs the measurement to the control unit 20. For example, the sensor 60 is realized by a positioning sensor using a positioning signal of GNSS (For example, GPS), an inertial sensor (Velocity sensor, acceleration sensor, angular velocity sensor, etc.), a magnetic sensor, and the like.

The display unit 70 is realized by, for example, a liquid crystal panel. The display unit 70 displays various kinds of information related to ship control and the state of the ship. The display unit 70 may be omitted, but it is preferable to have one. By having the display unit 70, the user may easily grasp the state of the ship control, the state of the ship, the control state of the ship, etc.

The propulsion force generation unit 91, the rudder 92 and the rudder angle sensor 920 are connected to the control unit 20. The control unit 20 and the propulsion force generation unit 91 are connected through, for example, the switching unit 200 and a communication network (CAN, etc.) for propulsion. The control unit 20 and the rudder 92 are connected through the switching unit 200 and an analog or digital communication line. The control unit 20 and the rudder angle sensor 920 are connected through an analog or digital communication line, for example.

The propulsion force generation unit 91 and the rudder 92 are provided in, for example, an outboard motor, an inboard motor, an inboard and outboard motor, and various propellers. The rudder 92 uses a hydraulic drive system to rotate the rudder and adjust the rudder angle.

Each of the propulsion force generation unit 91 and the rudder 92 are provided in the ship 90, for example. That is, the ship 90 equipped with the ship control device 10 of this embodiment is a so-called ship (hull) with one shaft and one rudder. The ship (hull) with one shaft and one rudder includes a ship (hull) equipped with a single command system and synchronizes rudder angle and shift/throttle operations, even if it has multi-engines.

The rudder angle sensor 920 measures the rudder angle (actual rudder angle) of the rudder 92 and outputs it to the control unit 20.

(Navigation Control Mode)

The ship control device 10 has a high-speed navigation control mode and a low-speed navigation control mode. The high-speed navigation control mode and the low-speed navigation control mode may be switched by an operation input to the operation button 331 (FIG. 4), for example. A specific example of switching between the high-speed navigation control mode and the low-speed navigation control mode using the operation button 331 will be described later in the description of the operation button 331.

In the manual operation (manual ship operation) of the high-speed navigation control mode, the second operator 40 is used. The second operator 40 outputs the throttle command signal at the operation input value based on the operation input from the user to the propulsion force generation unit 91 through the switching unit 200. The second operator 40 outputs the command rudder angle at the operation input value based on the operation input from the user to the rudder 92 through the switching unit 200. The throttle command signal in manual operation is a signal for specifying the shift setting (F/N/R) and the throttle opening in the propulsion force generation unit 91. The command rudder angle in manual operation directly specifies the rudder amount of the rudder 92.

In automatic navigation in the high-speed navigation control mode, the control unit 20 executes high-speed automatic navigation (autopilot) control based on settings from the AP operation unit 50. The control unit 20 generates a throttle command signal and a command rudder angle for high-speed automatic navigation control based on the settings related to high-speed autopilot control from the AP operation unit 50. The control unit 20 outputs a throttle command signal for high-speed automatic navigation control to the propulsion force generation unit 91 through the switching unit 200. The control unit 20 adjusts the throttle command signal for high-speed self-propelled navigation control so as to maintain the set ship speed based on the ship speed measured by the sensor 60.

The control unit 20 generates a rudder angle command signal for high-speed automatic navigation control from a difference value between an actual rudder angle and a command rudder angle measured by the rudder angle sensor 920. The control unit 20 outputs the rudder angle command signal for high-speed automatic navigation control to the rudder 92 through the switching unit 200.

In the low-speed navigation control mode, for example, a manual operation (manual rudder) mode or a low-speed automatic navigation control mode is selected based on an operation input to an operation button for detecting the start or stop of low-speed automatic navigation in the first operator 30 (described in detail later).

In the manual operation control mode of the low-speed navigation control mode, the control unit 20 generates a throttle command signal and a command rudder angle in the manual operation control mode based on an operation input value from the first operator 30. The throttle command signal in the manual operation is a signal for specifying the shift setting (F/N/R) and the throttle opening in the propulsion force generation unit 91. The command rudder angle in the manual operation directly specifies the rudder amount of the rudder 92.

In the low-speed navigation control mode, the control unit 20 switches from the manual operation control mode to the automatic navigation control mode based on the operation input from the first operator 30. Further, the control unit 20 sets the throttle opening and the target direction, which are the control parameters of the automatic navigation control mode, based on the operation input value from the first operator 30 after the changeover.

In the automatic navigation control mode, the control unit 20 generates a throttle command signal based on the set throttle opening to hold the ship speed constant, and outputs it to the propulsion force generation unit 91 through the changeover unit 200.

In the automatic navigation control mode, the control unit 20 generates a command rudder angle based on the set target direction to perform the automatic direction holding control. The control unit 20 generates a rudder angle command signal of the automatic navigation control mode from the difference value between the actual rudder angle and the command rudder angle measured by the rudder angle sensor 920. The control unit 20 outputs the rudder angle command signal of the automatic navigation control mode to the rudder 92 through the switching unit 200.

(Determination Concept of the Structure and Operation Input Value of the First Operator 30)

Figure 2:
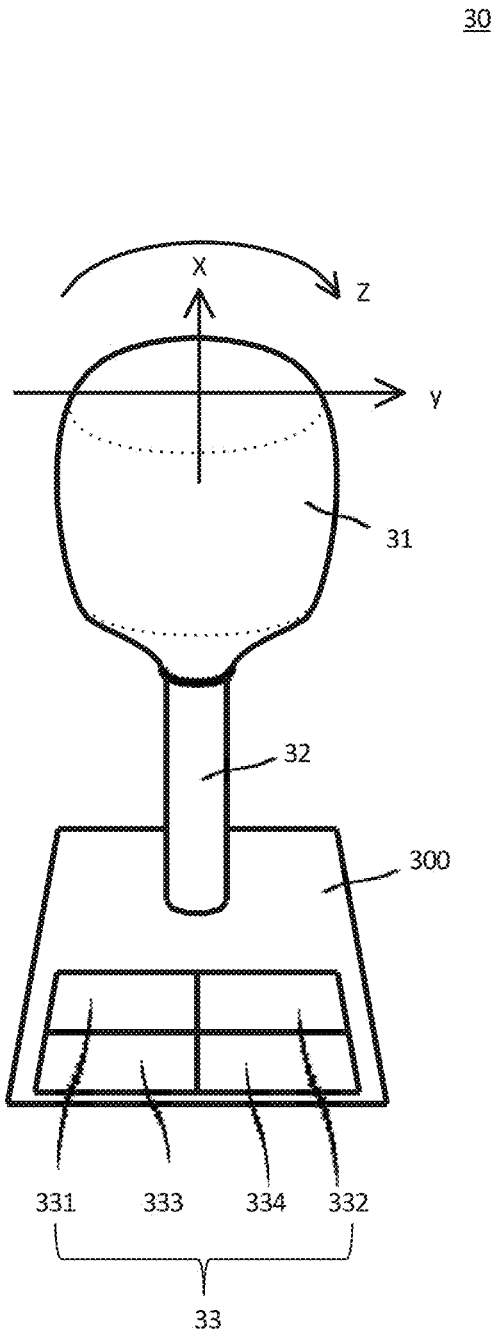
FIG. 2 is an external perspective view of a joystick.
Figure 3A:
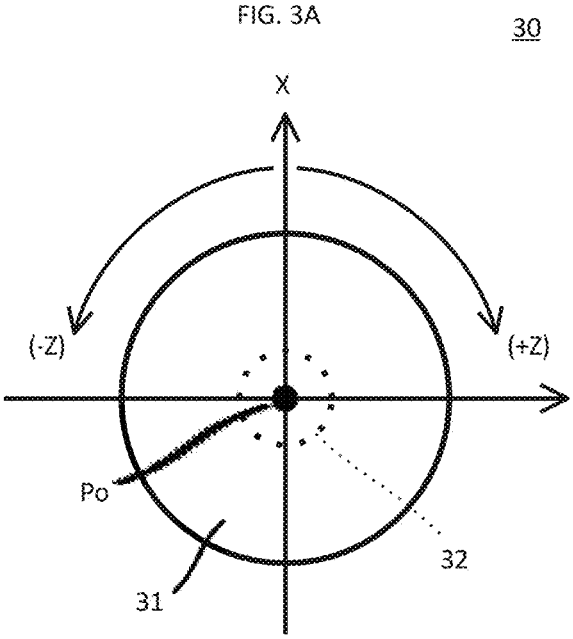
FIGS. 3A to 3C are diagrams for explaining the behavior of a joystick.
Figure 3B:
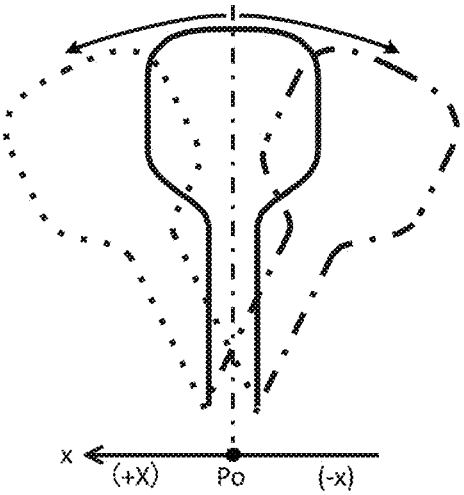
Figure 3C:
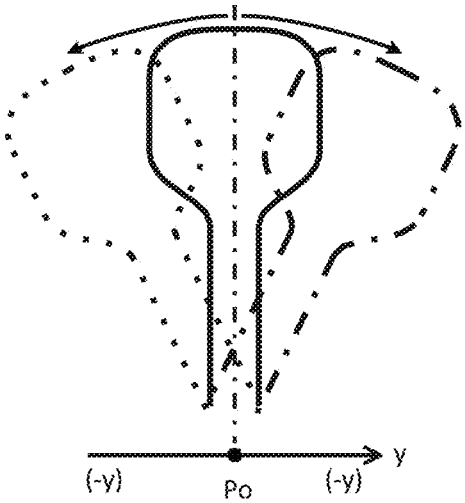
Figure 4:
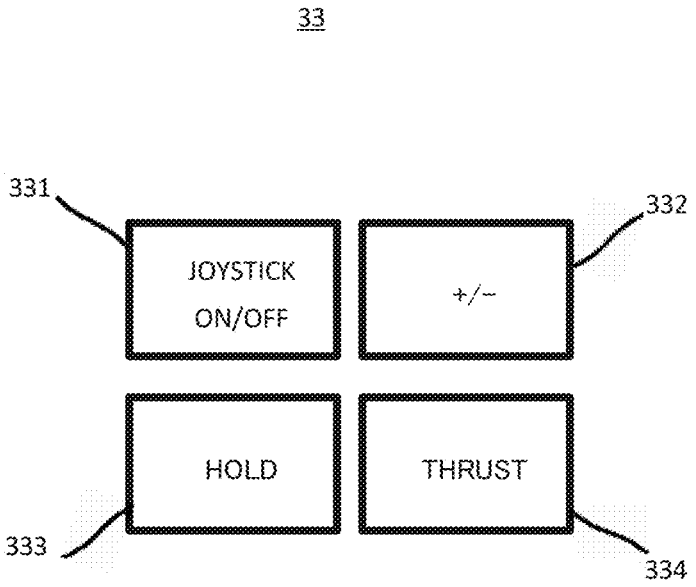
FIG. 4 is a diagram showing an example of a plurality of operation buttons.

FIG. 2 is an external perspective view of a joystick. FIGS. 3A, 3B, and 3C are views for explaining the behavior of the joystick, FIG. 3A is a plan view, and FIGS. 3B and 3C are side views. FIG. 4 is a view showing an example of a plurality of operation buttons.

As shown in FIG. 2, the first operator 30 includes a joystick (head 31 and shaft 32) and a button group 33. The button group 33 includes a plurality of operation buttons 331-334 (331, 332, 333, 334).

(Operation Input by Joystick)

The root of the shaft 32 is fixed to a base (For example, the deck of the wheelhouse of the ship 90, etc.) so that its planar position does not change. A head 31 is attached to the tip of the shaft 32. The plurality of operation buttons 331-334 constituting the button group 33 are arranged on the base near the root of the shaft 32.

The position of the tip of the shaft 32, i.e., the position of the head 31, is changed relative to the root of the shaft 32 by the user's operation on the head 31. Specifically, as shown in FIGS. 3 (B) and 3 (C), the position of the root of the shaft 32 in the default state (the state in which the user is not operating the head 31) is set as the reference point Po, and a two-dimensional plane orthogonal to the axis of the shaft 32 is set. The position of the head 31 is changed by the user's operation (maneuvering) on this two-dimensional plane.

For example, the position of the head 31 is changed by the user pushing and pulling the head 31 and tilting the shaft 32. Furthermore, as shown in FIG. 3A, the head 31 is rotatable about the axis of the shaft 32.

The plurality of operation buttons 331-334 may be operated by the user touching them with his finger.

The first operator 30 includes an operation input value generation unit (not shown). The operation input value generation unit is, for example, a sensor for detecting the position of the head 31 on a two-dimensional plane and the amount of rotation of the head 31. The operation input value generation unit generates an operation input value corresponding to the position of the head 31 and the amount of rotation of the head 31.

Specifically, the operation input value generation unit detects the position of the head 31 in the direction parallel to the direction of the ship in the x-axis direction, and generates an operation input value (x) based on this position. For example, as shown in FIG. 3B, the joystick value generation unit sets the forward direction as the +x direction and the backward direction as the −x direction.

The operation input value generation unit detects the position of the head 31 in the direction orthogonal to the direction of the ship (the right port direction) as the position in the y-axis direction, and generates an operation input value (y) based on this position. For example, as shown in FIG. 3C, the joystick value generation unit sets the starboard direction (the right rotation direction) as the +y direction and the port direction (the left rotation direction) as the −y direction.

An operation input value generation unit detects a rotation direction and a rotation angle (rotation amount) of the head 31, and generates an operation input value (z) based on the rotation direction and the rotation angle. More specifically, an operation input value generation unit detects a rotation direction of the head 31 using a state in which the head 31 is not rotated and operated as a reference state. For example, a joystick value generation unit detects a rotation amount from a reference state, and generates an operation input value (z), as shown in FIG. 3A, by using a clockwise direction (clockwise) as the +2 direction and a counterclockwise direction (counterclockwise) as the −z direction.

The operation input value generation unit outputs these operation input values (x), operation input values (y), and operation input values (z) to the control unit 20.

(Operation Input by Operation Button Group)

The operation button 331 is a button for selecting whether the joystick is enabled or disabled. The operation button 332 is a button for specifying an increase or decrease of a set value, set by another operation button or the like. The operation button 333 is a button for selecting the activation or inactivation of the low-speed automatic navigation control mode. The operation button 334 is a button for selecting the activation or inactivation of the intermittent slot in the low-speed automatic navigation control mode.

An operation input value generation unit detects an operation to the plurality of operation buttons 331-334 and generates an operation input value corresponding to the operation.

(Operation Input Value (x), Operation Input Value (y), Operation Input Value (z))

Figure 5A:
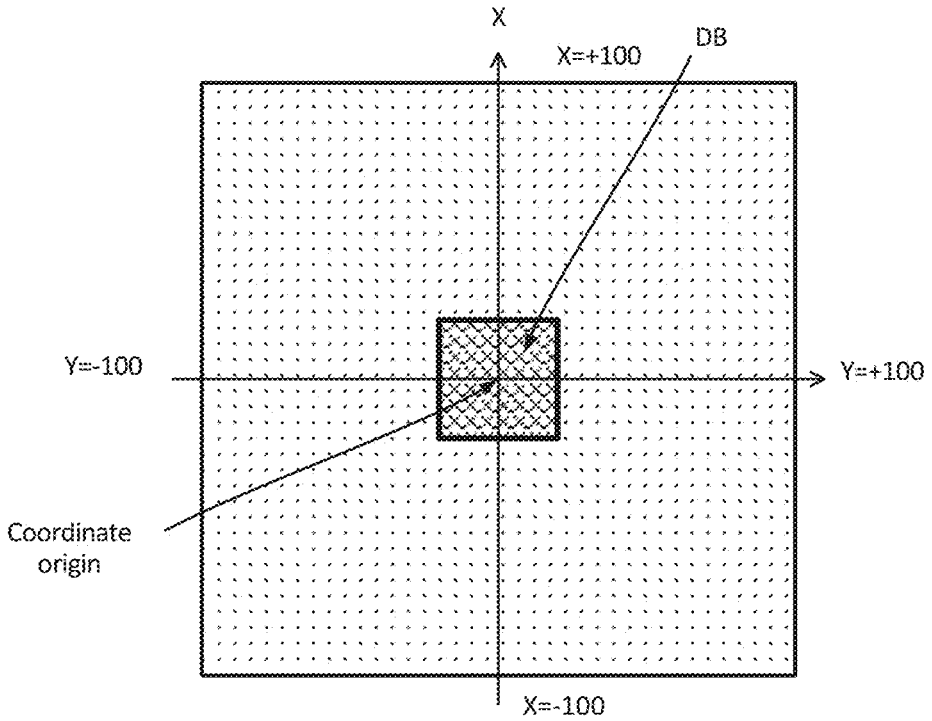
FIG. 5A is a diagram showing an example of the relationship between the position where the head is viewed in plan and the value of the operation input value (x) and the value of the operation input value (y)
Figure 5B:
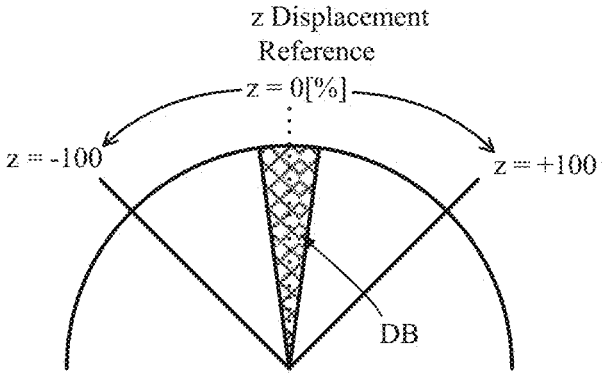
FIG. 5B is a diagram showing an example of the relationship between the amount of rotation of the head and the value of the operation input value (z).

FIG. 5A is a diagram showing an example of the relationship between the position where the head is viewed in plan and the value of the operation input value (x) and the value of the operation input value (y), and FIG. 5B is a diagram showing an example of the relationship between the rotation amount of the head and the value of the operation input value (z).

As shown in FIG. 5A, the operation input value (x) is set to x=0 (coordinate origin) when the head 31 is in the default state (shift N). The operation input value (x) is set to the maximum value +100 when it is farthest from the default position in the forward direction. The operation input value (x) is set so that the value becomes larger as the position of the head 31 moves away from the default position in the +x direction in the two-dimensional plane.

When the operation input value (x) is farthest from the default position in the backward direction, the minimum value is −100. The operation input value (x) is set so that. The further the position of the head 31 is from the default position in the −x direction in the two-dimensional plane, the smaller the value.

As shown in FIG. 5A, the operation input value (y) is the maximum value +100 when the head 31 is farthest from the default position in the starboard direction. The operation input value (y) is set so that the value increases as the position of the head 31 is further from the default position in the direction +y in the two-dimensional plane.

The minimum operation input value (y) is −100 when the head 31 is furthest from the default position in the port direction. The operation input value (y) is set so that the further the position of the head 31 is from the default position in the two-dimensional plane in the −y direction, the smaller the value.

As shown in FIG. 5B, the operation input value (z) represents the rotation state (rotation direction and rotation amount) of the head 31, and the maximum value z=+100 is acquired when the head is rotated most from the default position in the right rotation direction as viewed from the tip side of the head 31. In the case of right rotation, the value of the operation input value (z) is set to increase as the rotation amount (absolute value of the rotation angle) from the default state increases.

The minimum value of the operation input value (z) is −100 when the head is most rotated from the default position in the left rotation direction as viewed from the tip side of the head 31. In the case of left rotation, the value of the operation input value (z) is set so that the value becomes smaller as the rotation amount (absolute value of the rotation angle) from the default state becomes larger.

(Multiple Operation Buttons)

The operation button 331 is a button for selecting whether the joystick is enabled or disabled. For example, when the operation button 331 is operated (For example, touch, press) while the joystick is disabled, the joystick is enabled. The operation to the operation button 331 is enabled when the ship speed is below the switching threshold and the throttle lever and the joystick are shifted N (neutral). On the other hand, when the operation button 331 is operated while the joystick is enabled, the joystick is disabled.

The operation button 332 is a button for adjusting the set value. The operation button 332 sequentially changes the set value each time it is operated. For example, each time the operation button 332 is operated, the set value is set to decrease sequentially from the maximum value. When the set value reaches the minimum value and the operation button 332 is further operated, the set value is set to increase sequentially from the minimum value.

The operation button 333 is a button for selecting the automatic navigation control mode in the low-speed navigation control mode. For example, in the manual operation control mode in the low-speed navigation control mode, when the ship is moving forward, the operation button 333 is operated (For example, touch, press). As a result, the control unit 20 starts the automatic navigation control mode using the ship speed and the heading as initial values.

After the start of the automatic navigation control mode, the joystick is returned to the DB range (within the shift N (neutral) range) (For example, returning the head 31 to the position of the coordinate origin), so that the target direction and throttle opening using the joystick in the automatic navigation control mode may be set.

When the operation button 333 is operated during the automatic navigation control mode, the automatic navigation control mode is cancelled and switched to the manual operation control mode.

The operation button 334 is a trigger button for intermittent throttle control. The operation button 334 is set so that intermittent throttle control may be switched on (operation) and off (non-operation) every time it is operated. When the control unit 20 detects the operation of the operation button 334 when intermittent throttle control is off, it starts intermittent throttle control. When the control unit 20 detects the operation of the operation button 334 when intermittent throttle control is on, it stops intermittent throttle control.

(Example of Using the Operation Input Value in the Manual Operation Control Mode in the Low-Speed Navigation Control Mode)

FIG. 6A is a table showing an example of the relationship between the operation input value (x), the shift, and the throttle opening in the manual operation control mode, and FIG. 6B is a table showing an example of the relationship between the operation input value (y) and the command rudder angle in the manual operation control mode.

In the manual operation control mode in the low-speed navigation control mode, the control unit 20 sets the throttle opening based on the operation input value (x). For example, in general, the control unit 20 sets the throttle opening to increase as the operation input value (x) increases.

More specifically, when the operation input value (x) is within the DB range near 0 (see FIG. 5A), the control unit 20 sets the shift N (neutral) and sets the throttle opening to 0. When the operation input value (x) is outside the DB range and is a positive value (+ value), the control unit 20 sets the shift F (forward) and sets the throttle opening to increase as the absolute value of the operation input value (x) increases.

When the operation input value (x) is outside the DB range and is a negative value (− value), the control unit 20 sets the shift R (backward) and sets the throttle opening to increase as the absolute value of the operation input value (x) increases.

In the manual operation control mode in the low-speed navigation control mode, the control unit 20 sets the command rudder angle based on the operation input value (y). For example, in general, the control unit 20 sets the command rudder angle so that the larger the operation input value (y), the larger the command rudder angle.

More specifically, when the operation input value (y) is within the DB range near 0 (see FIG. 5A), the control unit 20 sets the rudder angle dead zone and sets the command rudder angle to 0°. When the operation input value (y) is outside the DB range and has a positive value (+ value), the control unit 20 sets the right turning rudder angle and sets the command rudder angle to increase as the absolute value of the operation input value (y) increases.

When the operation input value (y) is outside the DB range and has a negative value (− value), the control unit 20 sets the left turning rudder angle and sets the command rudder angle to increase as the absolute value of the operation input value (y) increases.

In the manual operation control mode in the low-speed navigation control mode, the control unit 20 adjusts the maximum value of the throttle opening degree based on the operation input value (z).

(Example of Use of Operation Input Value in Automatic Navigation Control Mode in Low-Speed Navigation Control Mode)

(Target Direction)

FIG. 7A is a table showing an example of the relationship between the operation input value (y) in the automatic navigation control mode and the change rate of the target direction in the slow navigation control mode, and FIG. 7B is a table showing an example of the relationship between the operation input value (z) in the automatic navigation control mode and the change rate of the target direction in the slow navigation control mode.

The change rate setting unit 212 of the target direction setting unit 211 of the setting unit 21 of the control unit 20 sets the change rate of the target direction based on the operation input value (y). The change rate of the target direction means the amount of change of the target direction per second. When the change rate is a + value, it corresponds to the right turning angle, and when the change rate is a − value, it corresponds to the left turning angle.

Specifically, as shown in FIG. 7A, the change rate setting unit 212 sets a plurality of ranges for the operation input value (y). When the operation input value (y) is in the range from +85 to +100, the change rate setting unit 212 sets the change rate of the target direction at +5°/sec. When the operation input value (y) is in the range from 0 to +86, the change rate setting unit 212 sets the change rate of the target direction to +1°/sec.

When the operation input value (y) is in the range from −85 to 0, the change rate setting unit 212 sets the change rate of the target direction to −1°/sec. When the operation input value (y) is in the range of −100 to −85, the change rate setting unit 212 sets the change rate of the target direction to −5°/sec.

As shown in FIG. 7B, the change rate setting unit 212 sets a plurality of ranges for the operation input value (z). If the operation input value (z) is in the range from +85 to +100, the change rate setting unit 212 sets the change rate of the target direction to +5°/sec. When the operation input value (z) is in the range from 0 to +85, the change rate setting unit 212 sets the change rate of the target direction to +1°/sec.

When the operation input value (z) is in the range from −85 to 0, the change rate setting unit 212 sets the change rate of the target direction to −1°/sec. When the operation input value (z) is in the range from −100 to −85, the change rate setting unit 212 sets the change rate of the target direction to −5°/sec.

Thus, in the control unit 20, the change rate setting unit 212 sets the change rate of the target direction used for the automatic navigation control mode in the low-speed navigation control mode based on the operation input value (y) or the operation input value (z). The target direction in the target direction setting unit 211 of the setting unit 21 may be set by setting the rate of change. That is, the control unit 20 may set the target direction used for the automatic navigation control mode in the low-speed navigation control mode based on the tilting of the joystick shaft 32 in the port or starboard directions or the twisting of the head 31.

The target direction is related to the turning (turning) of the ship. Therefore, the user may set the target direction more intuitively by assigning the tilting (first tilting) or twisting of the ship in the port or starboard direction to the target direction. In addition, by adopting two kinds of operations for setting the target direction, the user may set the target direction more intuitively even when the user gets lost in the operation.

When both the operation input value (y) based on the tilting and the operation input value (z) based on the twisting are acquired, the control unit 20 adopts the operation input value (y) based on the tilting with priority. Thus, it is possible to prevent the user from incorrect setting of the target direction due to the undesired twisting operation of the joystick.

That is, in a situation where the user is gripping the joystick, the user may twist the joystick unnecessarily. Therefore, by giving priority to the operation input value (y) based on the tilting, the control unit 20 may more reliably set the target direction according to the user's intention.

Moreover, since the change rate of the target direction is set by a discrete value, the user may more simply set the target direction. For example, if the change rate of the target direction is continuously changed with respect to a tilting amount or a twisting amount, detailed setting becomes possible, but setting becomes difficult.

However, since the change rate of the target direction is a discrete value, the user may set the change rate of the target direction close to a desired value by simple operation. In particular, in the case of a ship, since the heading does not change abruptly, even if the change rate of the target direction is set by a discrete value, the change rate of the target direction that the user feels is almost desired may be set. Note that the set number of the discrete values is not limited to the above-described aspects and may be set appropriately.

(Throttle Opening and Cancel of Automatic Navigation Control Mode)

FIG. 8 is a table showing an example of the relationship between the operation input value (x) in the automatic navigation control mode and the change rate of the throttle opening in the slow navigation control mode.

The intermittent throttle setting unit 220 of the intermittent throttle signal generation unit 22 of the control unit 20 sets the change rate of the throttle opening based on the operation input value (x). The change rate of the throttle opening means the change amount of the throttle opening per second. A change rate of + corresponds to increasing the throttle opening, and a change rate of—corresponds to decreasing the throttle opening. Further, the control unit 20 cancels the automatic navigation control mode based on the operation input value (x).

Specifically, as shown in FIG. 8, the intermittent throttle setting unit 220 sets a plurality of ranges for the operation input value (x). When the operation input value (x) is in the range from the maximum value of the DB range to +100, the intermittent throttle setting unit 220 sets the change rate of the throttle opening to +5%/sec. In this case, the change resolution is, for example, +1%. When the operation input value (x) is in the range from −85 to the minimum value in the DB range, the intermittent throttle setting unit 220 sets the change rate of the target direction at −5%/sec. In this case, the change resolution is, for example, ±1%. The intermittent throttle setting unit 220 has an operation input value (x) in a range from −100 to −85, then, it sets the automatic navigation control mode to be canceled. The change rate of throttle opening is 5%/sec. and may be set appropriately by the user.

Thus, the control unit 20 may set the throttle opening used for the automatic navigation control mode in the low-speed navigation control mode and cancel the automatic navigation control mode based on the operation input value (x). That is, the control unit 20 may set the throttle opening used for the automatic navigation control mode in the low-speed navigation control mode and cancel the automatic navigation control mode based on the longitudinal direction of the shaft 32 of the joystick.

The throttle opening is related to the propulsive force of the ship, i.e., its behavior in the longitudinal direction. Therefore, by assigning the inclination in the longitudinal direction of the ship to the throttle opening degree, the user may set the throttle opening more intuitively.

In addition to the re-operation of the operation button 333 as described above, by assigning the cancel of the automatic navigation control mode to the simple operation of pulling the shaft 32 of the joystick to a cancel range (for example, the rearmost side), or by having the operating speed of the first tilting or second tilting exceed a predetermined speed, the user may intuitively and easily switch from the automatic navigation control mode to the manual operation control mode using the joystick.

In addition, the operation of pulling the shaft 32 of the joystick to the rearmost side is easily performed intuitively by the user. Therefore, for example, the automatic navigation control mode may be switched to the manual operation control mode at a moment's notice so as not to cause erroneous operation.

At this time, the control unit 20 cancels the automatic navigation control mode only when it detects that the operation input value (x) is within the set range (−95>x>−100) of releasing the automatic navigation control mode for a predetermined time (for example, 1 second). Thus, the cancel of the automatic navigation control mode due to the erroneous operation by the user may be suppressed.

Moreover, since the change rate of the throttle opening is set by a discrete value, the user may set the throttle opening more simply. For example, if the change rate of the throttle opening is continuously changed with respect to the tilting amount, detailed setting becomes possible, but setting becomes difficult. However, since the change rate of the throttle opening is a discrete value, the user may set the change rate of the throttle opening close to the desired value by simple operation. In particular, in the case of a ship, since the ship speed does not change rapidly, even if the change rate of the throttle opening is set by a discrete value, the change rate of the throttle opening that the user feels is almost desired may be set. Note that the number of settings of the discrete value is not limited to the above-described aspects and may be set appropriately.

Further, in the present embodiment, the throttle opening degree is increased and the throttle opening degree is reduced. Thus, the user may set the change rate of the throttle opening degree by a simpler operation.

(Setting Intermittent Throttle Control)

Intermittent throttle control may be performed only in automatic navigation control mode. That is, intermittent throttle control is enabled when automatic navigation control mode is selected, and intermittent throttle control is also cancelled when automatic navigation control mode is cancelled.

Figure 9:
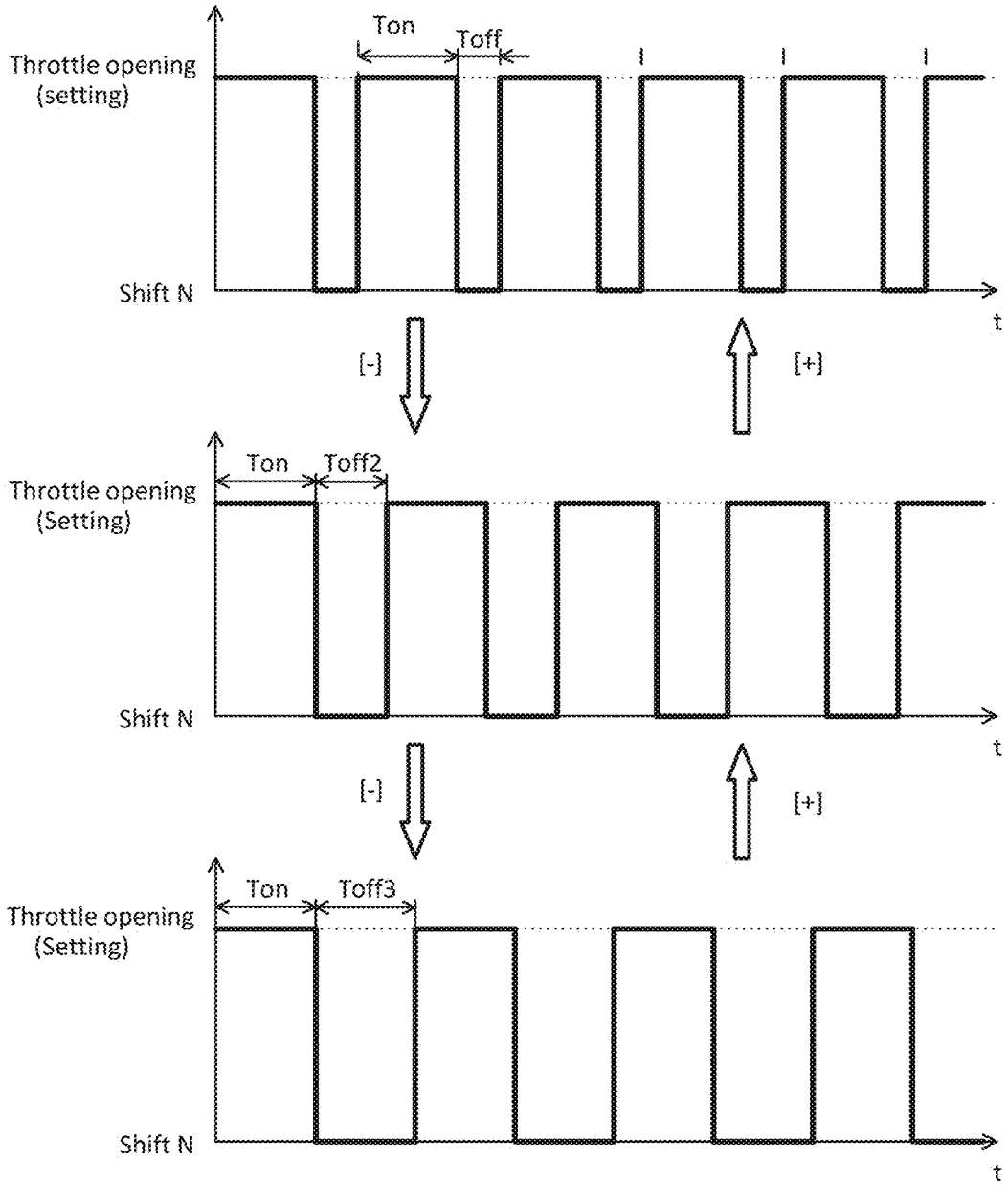
FIG. 9 is a diagram showing an example of the change of the duty ratio in the intermittent throttle control in the automatic navigation control mode in the slow navigation control mode.

FIG. 9 is a diagram showing an example of a change in the duty ratio under intermittent throttle control in the automatic navigation control mode of the slow navigation control mode.

As shown in FIG. 9, the intermittent throttle control is a control in which the two values of the throttle opening are set. During the setting the operation to the joystick and the throttle opening (dead throw) at the shift N are set in one cycle and repeated. This allows the time-average throttle opening to be smaller than the minimum throttle opening that may be set by the operation to the joystick. That is, a slower automatic navigation may be realized. More specifically, as a function of the intermittent throttle signal generation unit 22, the control unit 20 outputs an intermittent throttle signal having a binary value of High level and Low level to the propulsion force generation unit 91 to execute intermittent throttle control. The High level of the intermittent throttle signal corresponds to the on state (Throttle opening set by intermittent throttle setting unit 220 by operation to joystick), and the Low level corresponds to the off state (throttle opening at shift N (dead throw)).

The intermittent throttle control is set in three types: high state, medium state, and low state. The on time (Ton) of the high state, medium state, and low state is the same. The off time (Toff1) in the high state is shorter than the off time (Toff2) in the medium state. The off time (Toff3) in the medium state is shorter than the off time (Toff2) in the weak state.

Thus, the intermittent throttle control changes the duty ratio of one cycle by changing the off time while keeping the on time (Ton) constant in a plurality of states. That is, the cycle (frequency) of the intermittent throttle control differs in the high state, the medium state, and the low state.

The adjustment of the duty ratio of the intermittent throttle control (switching between the plurality of states) is realized by the operation to the operation button 332 when the intermittent throttle control is in the on state by the operation button 334.

Specifically, for example, by sequentially operating the operation buttons 332, the control unit 20 selects the intermittent throttle control in the order of the high state, the medium state, and the low state (change in the [−] direction in FIG. 9). Further, by sequentially operating the operation buttons 332, the control unit 20 selects the intermittent throttle control in the order of the low state, the medium state, and the high state (change in the [+] direction in FIG. 9). Thereafter, the above change is repeated every time the operation buttons 332 are operated.

That is, the on-duty ratio may be adjusted by sequentially operating the operation buttons 332 to adjust the off time, thereby substantially adjusting the strength of the throttle.

Thus, the user may easily set the duty ratio of the intermittent throttle control.

Although the present embodiment shows a case in which the intermittent throttle control is set to three stages, it is not limited to three stages and may be set to a predetermined plurality of stages.

(Setting of the Throttle Range)

FIG. 10 is a table showing an example of setting the range level of the throttle opening in the manual operation control mode. As shown in FIG. 10, the range level sets the setting range of the throttle opening by the joystick operation in the manual operation control mode. At this time, the range level has a different setting range for the shift F (the positive value side from the DB range) and the shift R (the negative value side from the DB range). The maximum throttle opening value of the range level MIDDLE is larger than that of the range level LOW, and the maximum throttle opening value of the range level HIGH is larger than that of the range level MIDDLE. Further, for each range level, the minimum and maximum values of the throttle opening that may be set are set larger for shift R than for shift F.

In the manual operation control mode in the low-speed navigation control mode, the control unit 20 sets the range level of the throttle opening. Specifically, the setting of the range level of the throttle opening is realized by an operation to the operation button 332 when the joystick is in the DB range (shift N).

Specifically, for example, by sequentially operating the operation buttons 332, the throttle range setting unit 23 of the control unit 20 selects the range level in the order of LOW, MIDDLE, and HIGH (a change in the direction from the top to the bottom in the table in FIG. 10). Further, by sequentially operating the operation buttons 332, the throttle range setting unit 23 selects the range level in the order of HIGH, MIDDLE, and LOW (a change in the direction from the top to the bottom in the table in FIG. 10). Thereafter, the above-described change is repeated every time the operation buttons 332 are operated.

Thus, by setting the range level, the user may select a range in which the range of throttle opening in the manual operation control mode may be set. The range of the throttle opening may be easily set by a button operation. The range level may be set even when the automatic navigation control mode and the intermittent throttle control is not selected.

Although not shown, the throttle opening adjustment unit 24 of the control unit 20 adjusts the throttle opening within the range set at the range level by changing the twisting amount (operation input value (z)) of the head 31 in a state where the shaft 32 is tilted forward to the maximum (operation input value (x)=+100). For example, by twisting the head 31 to the left side (−z direction), the throttle opening is reduced, and by twisting until the operation input value (z) reaches the minimum value, the throttle opening is set to the lower limit of the range level. On the other hand, by twisting the head 31 to the right side (+z direction), the throttle opening is increased, and by twisting until the operation input value (z) reaches the maximum value, the throttle opening adjustment unit 24 of the control unit 20 sets the throttle opening to the upper limit of the range level. Thus, the user may realize a more desired throttle opening.

(Ship Control Method)

Figure 11:
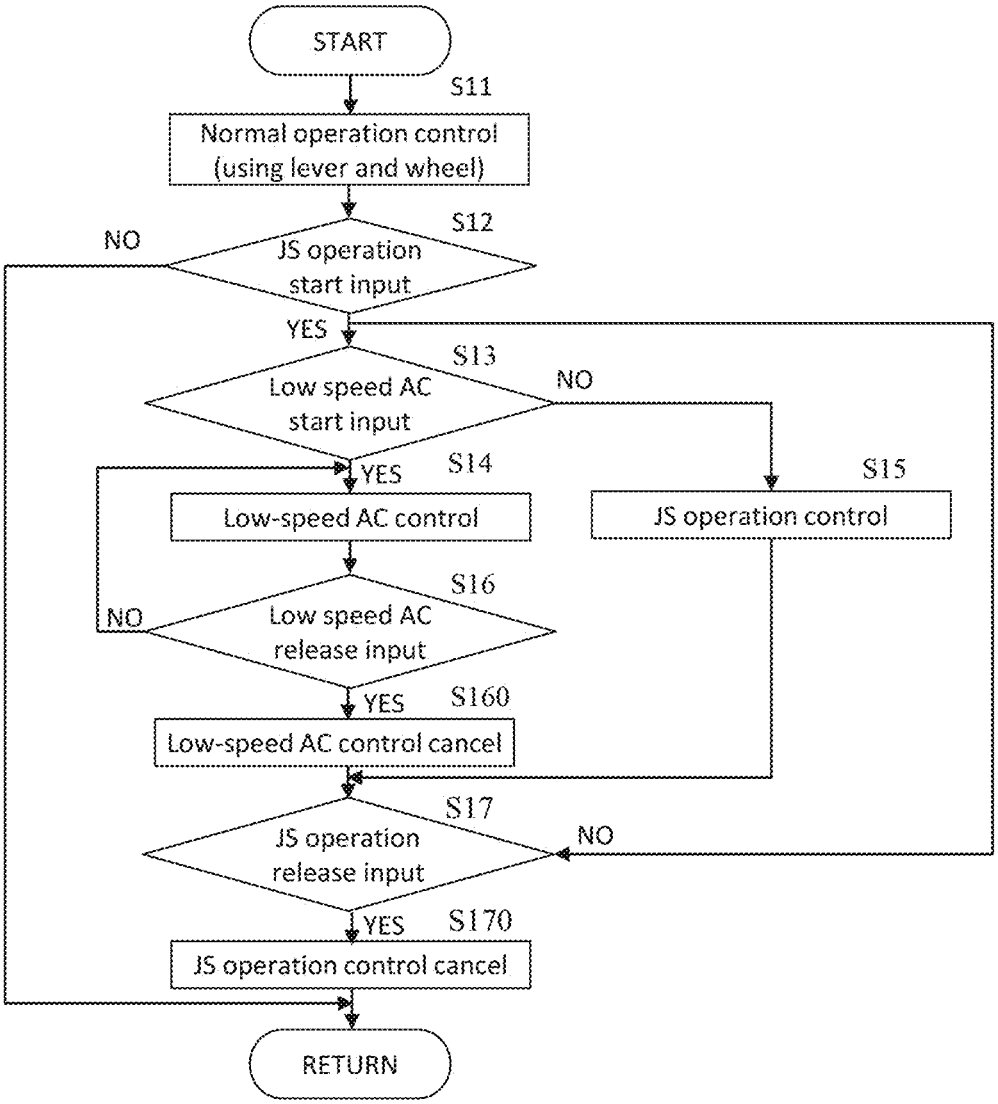
FIG. 11 is a flowchart showing a schematic process of a ship control method according to an embodiment of the present invention.

FIG. 11 is a flowchart showing a schematic process of a ship control method according to an embodiment of the present invention. In the description of each control (processing) shown in FIG. 11 and subsequent figures, the contents described in the above structure will be omitted. In FIG. 11 and subsequent figures, "AC" means the automatic navigation control mode of the slow navigation control mode, and "JS" means the joystick.

In the explanation of FIG. 11, the main subject of the processing is "the ship control device 10" or "the control unit 20," but in more detail, the processing is executed by the aforementioned functional units.

The ship control device 10 executes the control in the normal operation control mode (high-speed navigation control mode) (S11). At this time, a throttle lever and a steering wheel are used.

When the ship control device 10 detects the operation start input (operation button 331) by the joystick (S12: YES), it shifts to the low-speed navigation control mode. At this time, the ship control device 10 accepts the operation to the operation button 331 only when the throttle lever and the joystick are shifted N. This prevents the ship control device 10 from inadvertently transitioning to a slow navigation control mode by a negative desired operation on the operation button 331. If the ship control device 10 does not accept the operation start input (operation button 331) with the joystick (S12: NO), it maintains the fast navigation control mode.

When the ship control device 10 detects the operation input (operation button 333) for the start of the automatic navigation control mode in the slow navigation control mode (S13: YES), it shifts to the automatic navigation control mode (S14). If the ship control device 10 does not accept the operation input (operation button 333) of the automatic navigation control mode (S13: NO), it executes the manual operation control mode using the joystick (S15).

When the ship control device 10 detects the operation input (Re-operation of the operation button 333 or maximum rearward tilt operation of the joystick is maintained for a predetermined period of time.) of releasing the automatic navigation control mode (S16: YES), it cancels the automatic navigation control mode (S160).

When the ship control device 10 detects the operation input (re-operation of the operation button 331) of releasing the low-speed navigation control mode using the joystick (S17: YES), it cancels the low-speed navigation control mode using the joystick (S170) and switches to the high-speed navigation control mode. At this time, the ship control device 10 switches to the high-speed navigation control mode only when the throttle lever is shifted N. Thus, the ship control device 10 may prevent a sudden advance and a sudden backward movement after the transition to the high-speed navigation control mode.

The ship control device 10 maintains the low-speed navigation control mode until an operation input (re-operation of the operation button 331) for releasing the low-speed navigation control mode using the joystick, is detected (S17: NO).

(Setting Permission Method in the Low-Speed Navigation Control Mode)

Figure 12:
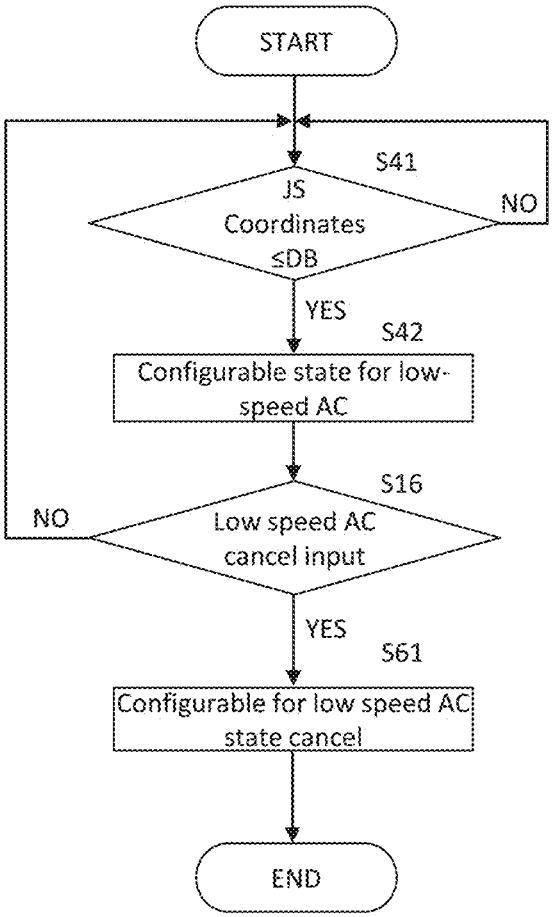
FIG. 12 is a flowchart showing an example of control for setting permission of target direction and throttle opening in the automatic navigation control mode of the slow navigation control mode.

FIG. 12 is a flowchart showing an example of control for setting permission of the target direction and throttle opening in the automatic navigation control mode of the low-speed navigation control mode.

After the automatic navigation control mode is started in the low-speed navigation control mode, the control unit 20 detects whether the position coordinates (JS coordinates) of the joystick are within the DB range.

If the JS coordinates are not within the DB range (S41: NO), the control unit 20 does not grant permission to start setting the target direction and throttle opening. If the JS coordinates are within the DB range (S41: YES), the control unit 20 permits the start of setting the target direction and the throttle opening (settable state for the low-speed navigation control mode) (S42).

If there is no operation input for releasing the automatic navigation control mode (S16: NO), the control unit 20 maintains the setting permission state of the target direction and the throttle opening (settable state for the low-speed navigation control mode). More specifically, in the setting permission state, if the JS coordinates are within the DB range (if they are returned), a flag is generated to enable the setting of the target direction and the throttle opening, and the setting of the target direction and the throttle opening becomes possible.

When there is an operation input to cancel the automatic navigation control mode (S16: YES), the control unit 20 cancels the automatic navigation control mode and cancels the setting permission state of the target direction and the throttle opening (settable state for the slow navigation control mode) (S61).

(Setting Method of the Target Direction in the Automatic Navigation Control Mode of the Slow Navigation Control Mode)

Figure 13:
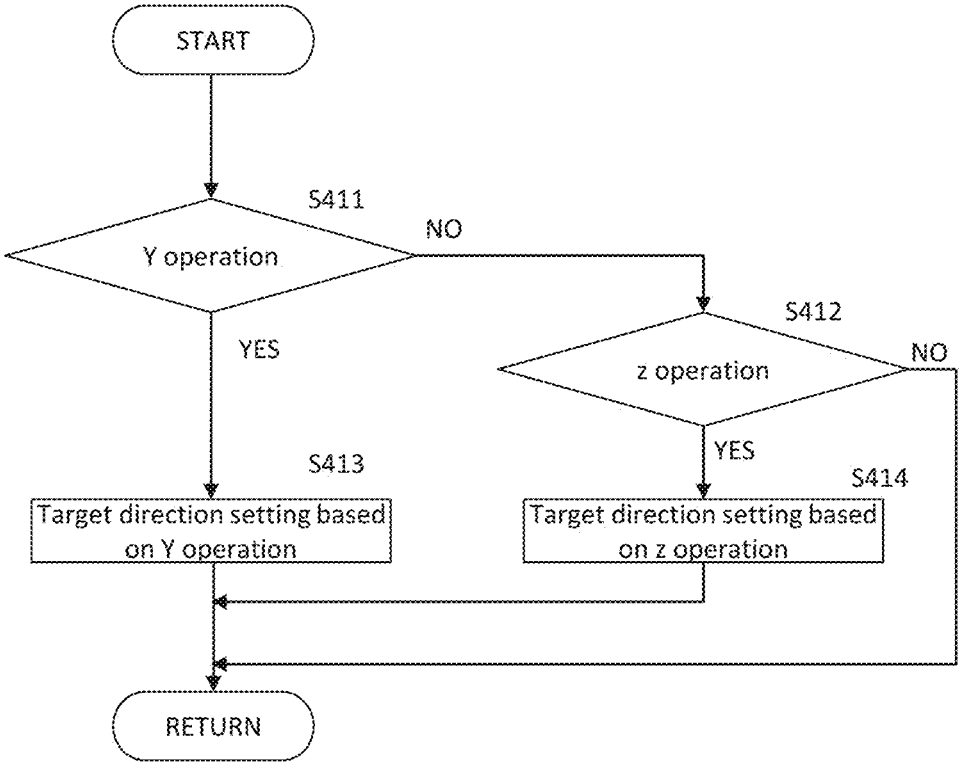
FIG. 13 is a flowchart showing an example of a method for setting a target direction in the automatic navigation control mode of the slow navigation control mode.

FIG. 13 is a flowchart showing an example of the setting method of the target direction in the automatic navigation control mode of the slow navigation control mode.

The control unit 20 detects an operation input value (y) by the y operation (lateral tilting) of the joystick and an operation input value (z) by the z operation (twisting). When the control unit 20 detects an operation input value (y) effective for setting (YES in S 411), it sets a target direction based on the operation input value (y) (S413).

When the control unit 20 cannot detect an operation input value (y) effective for setting (NO in S 411) and detects an operation input value (z) effective for setting (YES in S 412), it sets a target direction based on the operation input value (z) (S414).

(Setting of Throttle Opening Degree in Automatic Navigation Control Mode of Slow Navigation Control Mode and Releasing Method of Automatic Navigation Control Mode)

Figure 14:
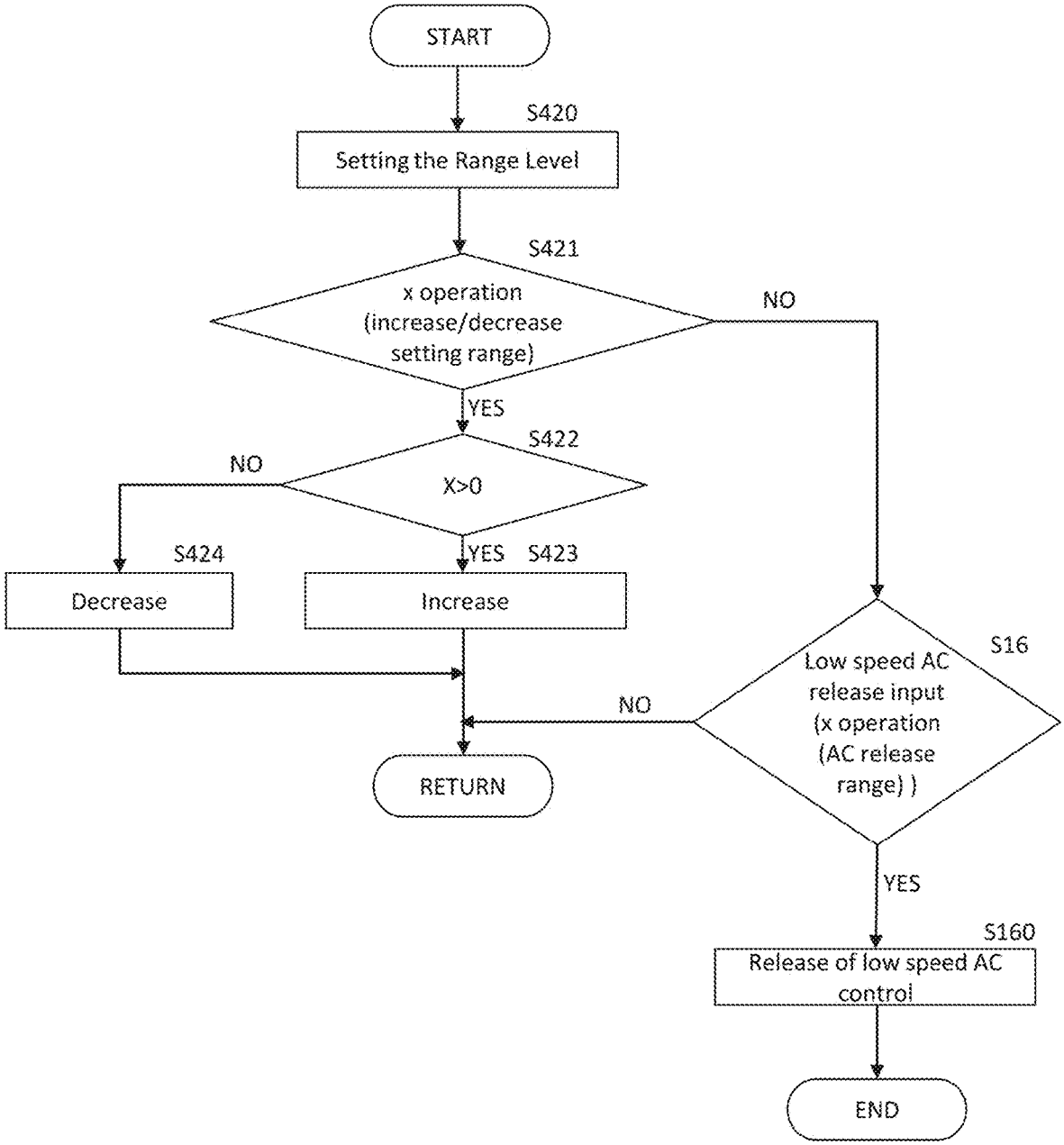
FIG. 14 is a flowchart showing a method of setting the throttle opening in the automatic navigation control mode of the slow navigation control mode and an example of releasing the automatic navigation control mode.

FIG. 14 is a flowchart showing a method for setting the throttle opening in the automatic navigation control mode of the low-speed navigation control mode and an example of releasing the automatic navigation control mode.

The control unit 20 sets the range level (HIGH/MIDDLE/LOW) (S420). The range level may be changed by the operation input to the operation button 332 as described above. Since the range level may be changed by the operation input to the operation button 332, the throttle opening may be changed by the operation input to the operation button 332 without operating the joystick.

The control unit 20 detects the x operation (tilting in the front-back direction) of the joystick. When the control unit 20 detects an operation input value (x) effective for setting the throttle opening (YES in S 421), it detects whether the operation input value (x) is a positive value or a negative value.

If it is a positive value (YES in S 422), the control unit 20 increases the throttle opening within the range level (S423). If it is a negative value (NO in S 422), the control unit 20 decreases the throttle opening within the range level (S424).

When the control unit 20 does not detect the operation input value (x) effective for setting the throttle opening (S421: NO) and detects that the operation input value (x) is in the release range of the automatic navigation control mode (S16: YES), the control unit cancels the automatic navigation control mode (S160).

(Intermittent Throttle Control Method)

Figure 15:
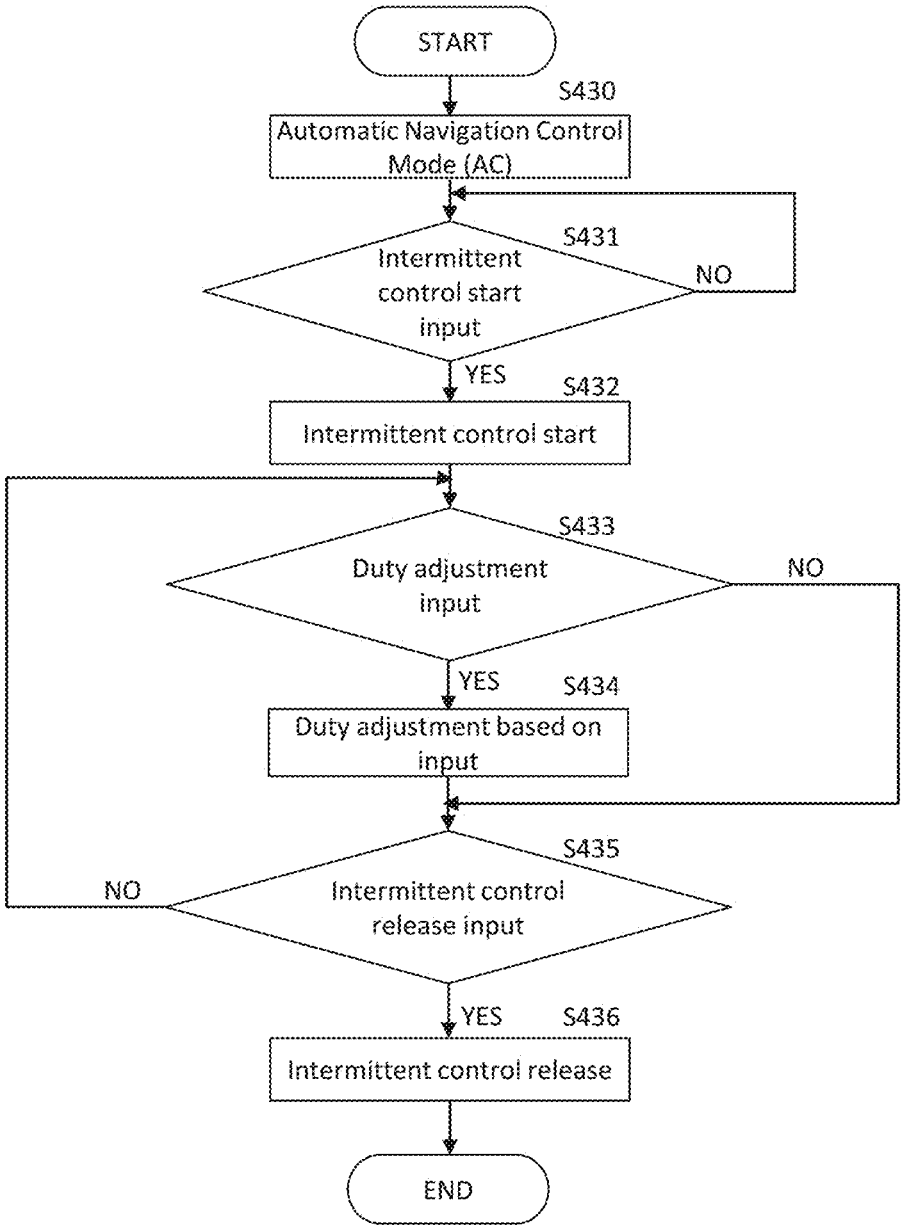
FIG. 15 is a flowchart illustrating an example of intermittent throttle control.

FIG. 15 is a flowchart showing an example of intermittent throttle control.

When the automatic navigation control mode is selected (S430) and the control unit 20 detects the operation input (operation button 334) for starting intermittent throttle control (S431: YES), it starts intermittent throttle control at the default duty ratio (S432).

When the control unit 20 detects the adjustment input (operation button 332) for the duty ratio (S433: YES), it adjusts the duty ratio based on the input (S434). When the control unit 20 does not detect the adjustment input (operation button 332) for the duty ratio (S433: NO), it maintains the duty ratio at that time.

The control unit 20 maintains the intermittent throttle control until it detects the operation input (operation button 334) for releasing the intermittent throttle control (S435: NO). When the control unit 20 detects the operation input (operation button 334) for releasing the intermittent throttle control (S435: YES), it cancels the intermittent throttle control (S436). When the automatic navigation control mode is selected, the control unit 20 cancels the intermittent throttle control together with the automatic navigation control mode.

(Adjusting the Throttle Range)

Figure 16:
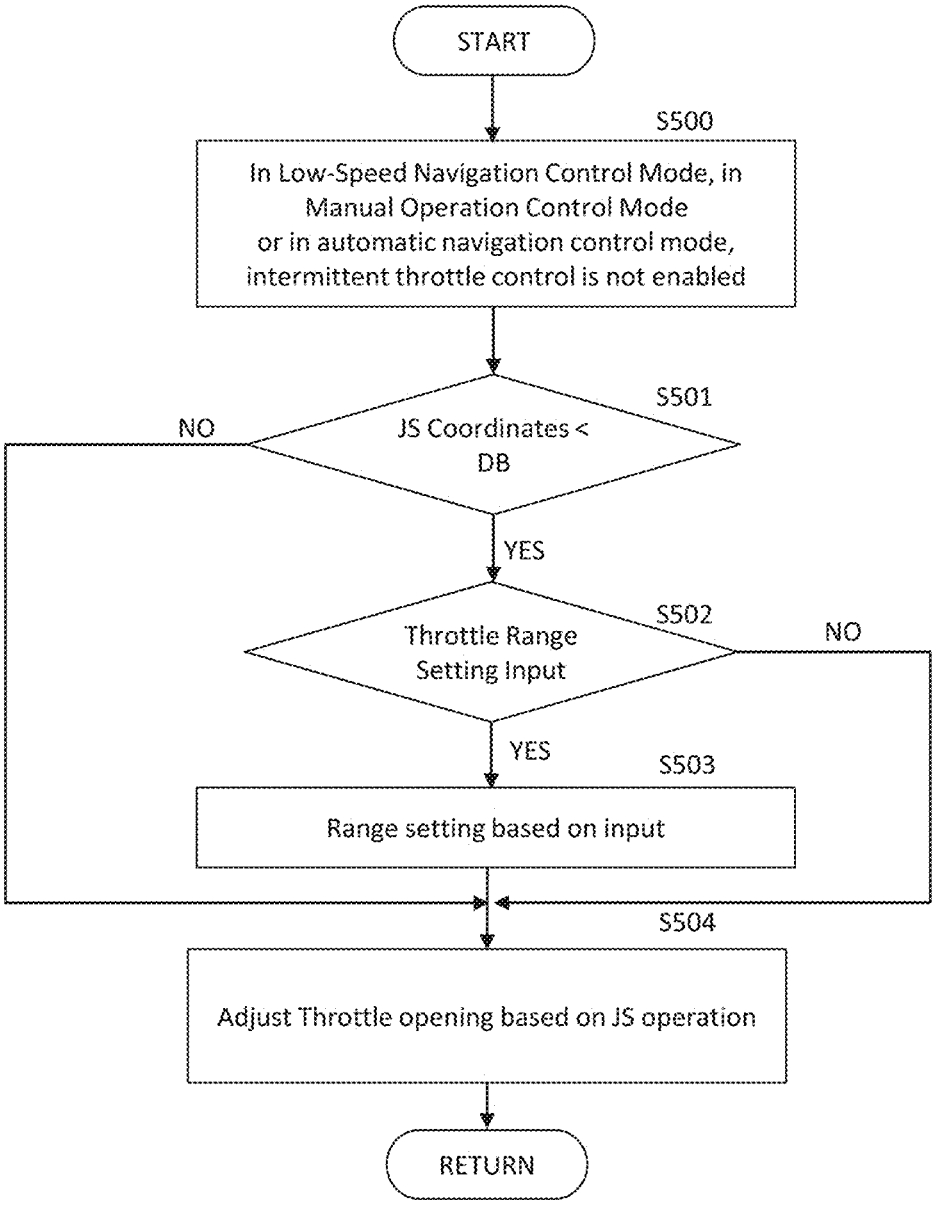
FIG. 16 is a flowchart showing an example of throttle range adjustment control.

FIG. 16 is a flowchart showing an example of throttle range adjustment control.

The control unit 20 detects the presence or absence of an operation input for throttle range setting if the JS coordinates are within the DB range (S501: YES) in the manual operation control mode in the slow navigation control mode or when the intermittent throttle control is not effective in the automatic navigation control mode.

If there is an operation input for throttle range setting (operation button 332) (S502: YES), the control unit 20 sets the range based on the input (S503). If there is no operation input for throttle range setting (operation button 332) (S502: NO), the control unit 20 maintains the throttle range level at that time.

The control unit 20 adjusts the throttle opening based on the set throttle range level and the joystick operation (operation input value (x)) (S504).

(Method for Adjusting Target Direction and Slot Opening in Automatic Navigation Control Mode in Slow Navigation Control Mode)

Figure 17:
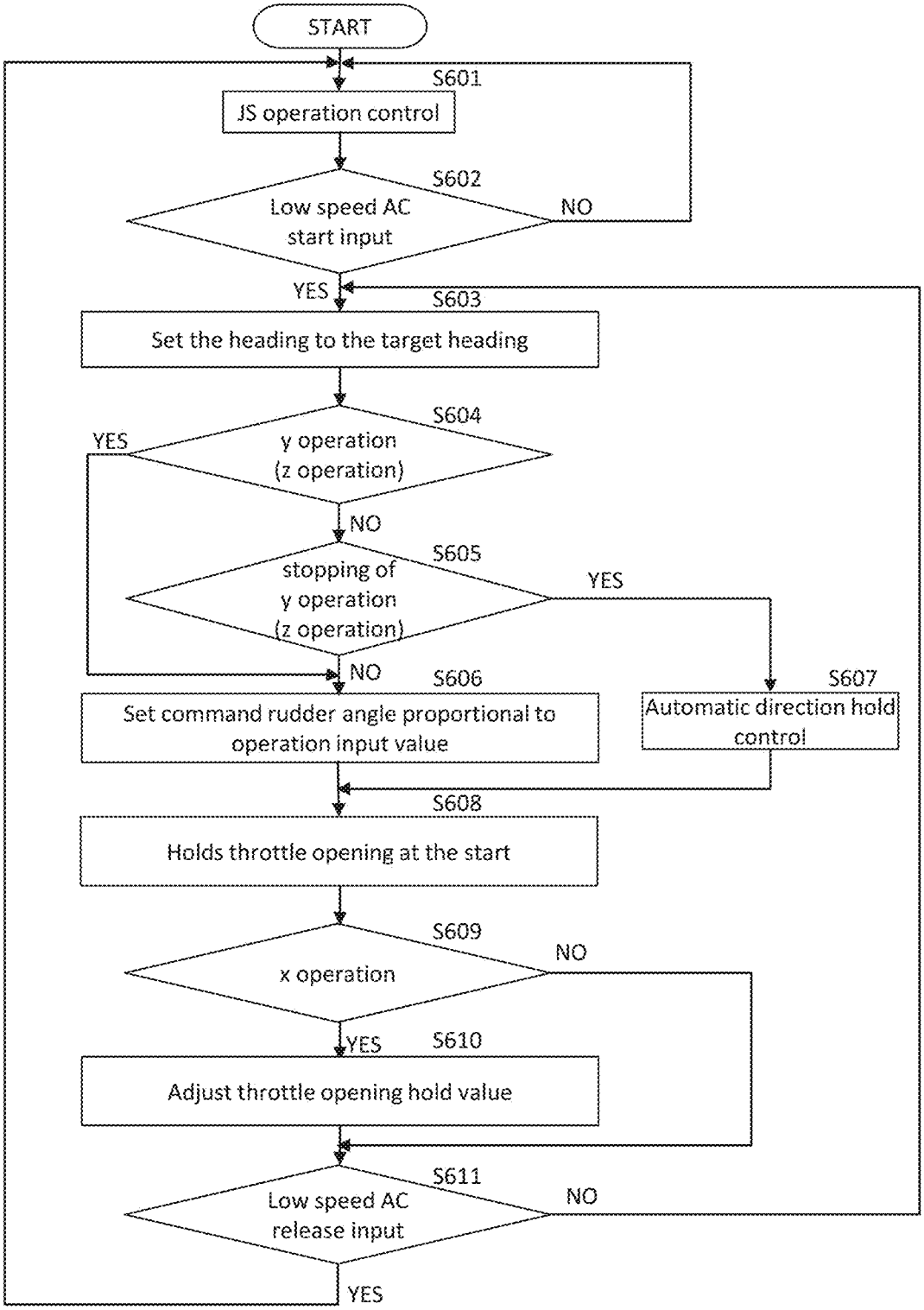
FIG. 17 is a flowchart showing an example of how to adjust the target direction and slot opening in the automatic navigation control mode in the slow navigation control mode.

FIG. 17 is a flowchart showing an example of a method for adjusting the target direction and the slot opening in the automatic navigation control mode in the low-speed navigation control mode.

When the control unit 20 detects the operation start input (operation button 331) with the joystick (For example, see the description of step S12 in FIG. 11.), it executes the low-speed navigation control mode of manual operation using the joystick (S601).

The control unit 20 continues the low-speed navigation control mode of manual operation using the joystick until the start input (For example, the operation input of the operation button 333) of the automatic navigation control mode is acquired (S602: NO). When the control unit 20 acquires the start input of the automatic navigation control mode (S602: YES), it starts the automatic navigation control mode in the low-speed navigation control mode.

When the control unit 20 is set to the automatic navigation control mode in the low-speed navigation control mode, the heading at this point is acquired from the sensor 60. The control unit 20 sets the acquired heading at this point to the target direction in the automatic direction holding control (S603). The automatic direction holding control automatically adjusts the rudder angle so as to maintain the set target direction.

The control unit 20 detects the operation input value (y) by the y operation (lateral tilting) and the operation input value (z) by the z operation (twisting) of the joystick. When the control unit 20 detects the y operation or the z operation (S604: YES), it sets the command rudder angle proportional to the operation input value (S606). Specifically, the control unit 20 sets the command rudder angle so that the command rudder angle increases as the operation input value increases, and so that the command rudder angle decreases as the operation input value decreases.

Proportionality here is not limited to a linear function relationship between the operation input amount and the command rudder angle. However, since the operation input amount and the command rudder angle are linear functions, the user may more intuitively adjust the command rudder angle.

When the control unit 20 detects the stop of the y operation or the z operation after the y operation or the z operation of the joystick has been performed (S605: YES), the control unit returns to the automatic direction holding control (S607).

Specifically, the control unit 20 detects the stop of the y operation or the z operation when the y operation or the z operation of the joystick has not been performed for a predetermined time (e.g., 3 seconds) or longer. The control unit 20 acquires the heading at the time of detecting the stop of the y operation or the z operation, sets the acquired heading to the target direction, and executes automatic direction holding control.

When this command rudder angle is set, the control unit 20 holds the throttle opening at the start of the self-propelled navigation control mode if the x operation is not performed (S608).

When the control unit 20 detects the operation input value (x) due to the x operation (bow/stern tilting) of the joystick (S609: YES), it adjusts the holding value of the throttle opening in the automatic direction holding control based on the operation input value (x) (S610).

If the control unit 20 does not detect the operation input value (x) due to the x operation of the joystick (tilting in the bow/stern direction) (S609: NO), the throttle opening already set is maintained.

The control unit 20 continues the automatic navigation control mode including the above-mentioned automatic direction holding control until the cancel input (For example, re-operation of the operation button 333 or maximum stern tilt of the joystick is maintained for a predetermined period of time.) of the automatic navigation control mode is acquired (S611: NO).

When the control unit 20 acquires the cancel input of the automatic navigation control mode (S611: YES), it terminates the automatic navigation control mode and shifts to the low-speed navigation control mode of manual operation using a joystick.

Figure 18:
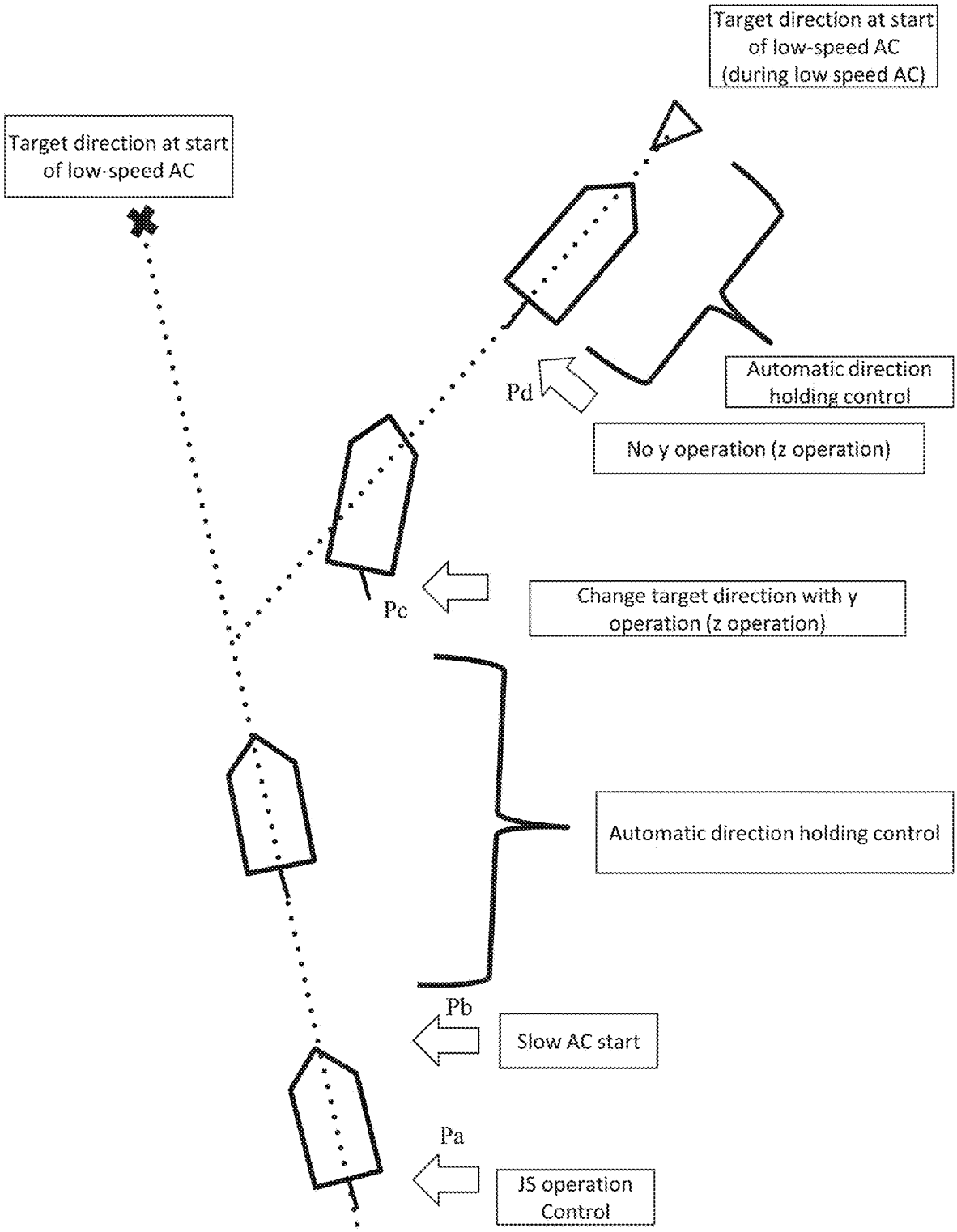
FIG. 18 shows an image of the adjustment of the target direction and slot opening in the automatic navigation control mode in the slow navigation control mode.

By performing such control, for example, the following maneuvering of a ship becomes possible. FIG. 18 is a diagram showing an image of the adjustment of the target direction and slot opening in the automatic navigation control mode in the slow navigation control mode.

The user performs manual low-speed navigation using the joystick of the first operator 30 (FIG. 18: Pa). At this time, the user directs the heading to the target direction at the time and performs manual operation using a joystick to achieve the desired ship speed.

When the desired heading and the desired ship speed are reached, the user inputs to start the automatic navigation control mode. Thus, the self-propelled navigation control mode in the low-speed navigation control mode is started (FIG. 18: Pb). The control unit 20 sets the current heading of the ship at this point to the target heading (the target heading at the start of low-speed AC in FIG. 18), and maintains the throttle opening at this point. The control unit 20 performs automatic direction holding control so as to maintain the target direction. The ship speed may be used instead of the throttle opening. In this case, the control unit 20 adjusts the throttle opening to maintain the target ship speed.

When the user attempts to change the navigation direction of the ship 90 during the automatic direction holding control, the user performs the y- or z-operation of the joystick (FIG. 18: Pc). When the control unit 20 detects this operation, it changes the rudder angle based on the y-operation input value or the z-operation input value. Thus, the user may change the navigation direction of the ship 90 to a desired direction.

The user stops the y- or z-operation of the joystick when the desired heading and desired ship speed are reached (FIG. 18: Pd). When the control unit 20 detects the stop of this operation, the heading at this point is set to the target direction (the target direction after the change of the direction in FIG. 18).

In this way, the user may easily and intuitively change the target direction during the automatic direction holding control. In this case, the ship speed may be maintained. The ship speed may be adjusted by the x operation of the joystick, as described above, even during the automatic direction retention control.

In the above description, an example in which the operation input value and the command rudder angle are set by one linear function in the whole operation input value. However, for the y operation input value or the z operation input value, the range of the operation input value may be divided into a plurality of ranges, and different linear functions may be set for each range.

Figure 19:
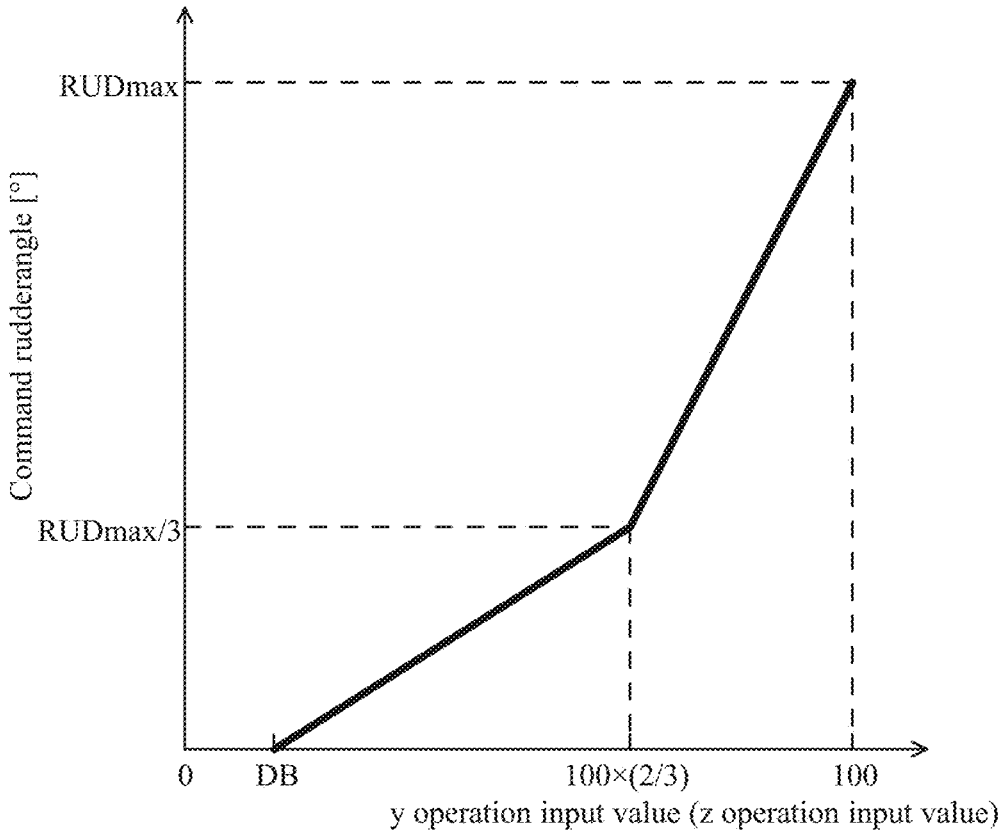
FIG. 19 is a graph 19 showing an example of the relationship between the operation input value and the command rudder angle.

FIG. 19 is a graph showing an example of the relationship between the operation input value and the command rudder angle. In FIG. 19, RUDmax is the maximum effective rudder angle.

In the example shown in FIG. 19, the y operation input value (z operation input value) is divided into the first range from DB to 100×(2/3), and the y operation input value (z operation input value) is divided into the second range from 100×(2/3) to 100. When the y operation input value (z operation input value) is in DB, the command rudder angle is set to 0°.

In the first range, the y operation input value (z operation input value) varies from the maximum value of DB to 100×(2/3), while the command rudder angle varies linearly from 0° to RUDmax/3.

In the second range, the y-operation input value (z-operation input value) varies from 100×(2/3) to 100, while the command rudder angle varies linearly from RUDmax/3 to RUDmax.

Thus, in the first range, the change of the command rudder angle in response to the change of the y-operation input value (z-operation input value) is slower than in the second range. Conversely, in the second range, the change of the command rudder angle in response to the change of the y-operation input value (z-operation input value) is steeper than in the first range.

Thus, in the first range where the command rudder angle is small, the change of the command rudder angle may be reduced in response to the change of the y-operation input value (z-operation input value). In the second range where the command rudder angle is large, the change of the command rudder angle may be increased in response to the change of the y-operation input value (z-operation input value).

The range of possible values of the y operation input value (z operation input value) in the first range is larger than the range of possible values of the y operation input value (z operation input value) in the second range.

By making such settings, the following effects may be acquired.

In order to operate the ship at the user's will by using the joystick, it is preferable that the turning response speed be high. On the other hand, if the turning (the amount of change in the command rudder angle) relative to the operation input value is large, the unsteadiness of the bow becomes large when holding the direction.

Therefore, referring to the experience that the turning amount when holding the direction is about +10°, the amount of change in the command rudder angle in the first range where the operation input value is small is reduced. As a result, the unsteadiness of the bow in the holding operation may be suppressed, and the stability of the holding operation may be improved.

On the other hand, by increasing the change amount of the command rudder angle in the second range where the operation input value is large, the rudder response speed may be increased. For example, when a sudden rudder is required, the user tilts the joystick port or starboard (in the y-direction) or twisting the head. In this case, the operation input value falls into the second range. Therefore, in such a case, it is possible to operate the ship nimbly, and it is possible to suppress the deterioration of operability in a sudden turning.

Furthermore, by setting the first range larger than the second range, it is possible to suppress erroneously instructing a large and unwanted turning during the direction holding operation. Moreover, since the range of the operation input value of the first range is large, the adjustment of the turning amount may be made more finely. Thus, it is easy to adjust the heading to the desired target direction, and the stability of the direction holding operation may be improved.

Terminology

It is to be understood that not necessarily all objects or advantages may be achieved in accordance with any particular embodiment described herein. Thus, for example, those skilled in the art will recognize that certain embodiments may be configured to operate in a manner that achieves or optimizes one advantage or group of advantages as taught herein without necessarily achieving other objects or advantages as may be taught or suggested herein.

All of the processes described herein may be embodied in, and fully automated via, software code modules executed by a computing system that includes one or more computers or processors. The code modules may be stored in any type of non-transitory computer-readable medium or other computer storage device. Some or all the methods may be embodied in specialized computer hardware.

Many other variations than those described herein will be apparent from this disclosure. For example, depending on the embodiment, certain acts, events, or functions of any of the algorithms described herein can be performed in a different sequence, can be added, merged, or left out altogether (e.g., not all described acts or events are necessary for the practice of the algorithms). Moreover, in certain embodiments, acts or events can be performed concurrently, e.g., through multi-threaded processing, interrupt processing, or multiple processors or processor cores or on other parallel architectures, rather than sequentially. In addition, different tasks or processes can be performed by different machines and/or computing systems that can function together.

The various illustrative logical blocks and modules described in connection with the embodiments disclosed herein can be implemented or performed by a machine, such as a processor. A processor can be a microprocessor, but in the alternative, the processor can be a controller, microcontroller, or state machine, combinations of the same, or the like. A processor can include electrical circuitry configured to process computer-executable instructions. In another embodiment, a processor includes an application specific integrated circuit (ASIC), a field programmable gate array (FPGA) or other programmable device that performs logic operations without processing computer-executable instructions. A processor can also be implemented as a combination of computing devices, e.g., a combination of a digital signal processor (DSP) and a microprocessor, a plurality of microprocessors, one or more microprocessors in conjunction with a DSP core, or any other such configuration. Although described herein primarily with respect to digital technology, a processor may also include primarily analog components. For example, some or all of the signal processing algorithms described herein may be implemented in analog circuitry or mixed analog and digital circuitry. A computing environment can include any type of computer system, including, but not limited to, a computer system based on a microprocessor, a mainframe computer, a digital signal processor, a portable computing device, a device controller, or a computational engine within an appliance, to name a few.

Conditional language such as, among others, "can," "could," "might" or "may," unless specifically stated otherwise, are otherwise understood within the context as used in general to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without user input or prompting, whether these features, elements and/or steps are included or are to be performed in any particular embodiment.

Disjunctive language such as the phrase "at least one of X, Y, or Z," unless specifically stated otherwise, is otherwise understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

Any process descriptions, elements or blocks in the flow diagrams described herein and/or depicted in the attached figures should be understood as potentially representing modules, segments, or portions of code which include one or more executable instructions for implementing specific logical functions or elements in the process. Alternate implementations are included within the scope of the embodiments described herein in which elements or functions may be deleted, executed out of order from that shown, or discussed, including substantially concurrently or in reverse order, depending on the functionality involved as would be understood by those skilled in the art.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a processor configured to carry out recitations A, B and C" can include a first processor configured to carry out recitation A working in conjunction with a second processor configured to carry out recitations B and C. The same holds true for the use of definite articles used to introduce embodiment recitations. In addition, even if a specific number of an introduced embodiment recitation is explicitly recited, those skilled in the art will recognize that such recitation should typically be interpreted to mean at least the recited number (e.g., the bare recitation of "two recitations," without other modifiers, typically means at least two recitations, or two or more recitations).

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.).

For expository purposes, the term "horizontal" as used herein is defined as a plane parallel to the plane or surface of the floor of the area in which the system being described is used or the method being described is performed, regardless of its orientation. The term "floor" can be interchanged with the term "ground" or "water surface." The term "vertical" refers to a direction perpendicular to the horizontal as just defined. Terms such as "above," "below," "bottom," "top," "side," "higher," "lower," "upper," "over," and "under," are defined with respect to the horizontal plane.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

Numbers preceded by a term such as "approximately," "about," and "substantially" as used herein include the recited numbers, and also represent an amount close to the stated amount that still performs a desired function or achieves a desired result. For example, the terms "approximately," "about," and "substantially" may refer to an amount that is within less than 10% of the stated amount. Features of embodiments disclosed herein preceded by a term such as "approximately," "about," and "substantially" as used herein represent the feature with some variability that still performs a desired function or achieves a desired result for that feature.

It should be emphasized that many variations and modifications may be made to the above-described embodiments, the elements of which are to be understood as being among other acceptable examples. All such modifications and variations are intended to be included herein within the scope of this disclosure and protected by the following claims.

What is claimed is:

1. A ship control device to be mounted on a ship, comprising:

an interface configured to acquire operation input from each of a first operator used in a low-speed navigation control mode and a second operator used in a high-speed navigation control mode; and processing circuitry configured to:

determine a target direction or a throttle opening based on the operation input, wherein the low-speed navigation control mode includes a manual operation control mode by operation of the first operator and an automatic navigation control mode for holding a direction using the target direction, or holding the throttle opening, wherein the processing circuitry is further configured to set the target direction or the throttle opening used for an automatic navigation based on the operation input from the first operator in the automatic navigation control mode, and automatically navigate the ship based on the operation input from the first operator, wherein the first operator is configured to comprise a joystick acquiring the operation input of a first tilting of a shaft in a port direction or a starboard direction and a twisting of a head, wherein the processing circuitry is further configured to set the target direction based on the first tilting or the twisting, wherein the first operator is further configured to comprise a throttle range selection button for selecting from a plurality of candidates a throttle range which the throttle opening is set by an operation input of a second tilting of the shaft of the joystick in the bow or stern direction of the ship, and wherein the processing circuitry is further configured to select and set the throttle range from the plurality of candidates for the throttle range based on the operation input to the throttle range selection button.

2. The ship control device according to claim 1, wherein the first operator is configured to comprise a joystick and an operation button, and wherein the processing circuitry is further configured to switch from the manual operation control mode to the automatic navigation control mode for holding the direction or the throttle opening at the time of the operation input to the operation button, and set the target direction or throttle opening used for the automatic navigation based on the operation input to the joystick satisfying a predetermined condition during the automatic navigation control mode.

3. The ship control device according to claim 1, wherein the processing circuitry is further configured to perform a direction control by changing a command rudder angle based on the operation input of the first tilting or the twisting of the joystick during the automatic navigation control mode, acquire a heading when a stop of the operation input of the first tilting or the twisting of the joystick is detected, and set the heading to the target direction.

4. The ship control device according to claim 3, wherein the processing circuitry is further configured to set the command rudder angle proportional to an amount of the first tilting or an amount of the twisting.

5. The ship control device according to claim 4, wherein the processing circuitry is further configured to set a first range in which the command rudder angle assigned to the amount of the first tilting or the amount of the twisting gradually increases, and a second range in which the command rudder angle assigned to the amount of the first tilting or the amount of the twisting sharply increases, and wherein the first range is larger than the second range.

6. The ship control device according to claim 5, wherein the first range is a range in which the amount of the first tilting or the amount of the twisting is smaller than the second range.

7. The ship control device according to claim 3, wherein the processing circuitry is further configured to detect the stop of the operation input of the first tilting or the twisting when the operation input of the first tilting or the twisting of the joystick has not been acquired for more than a predetermined time.

8. The ship control device according to claim 1, wherein the processing circuitry is further configured to give priority to the first tilting over the twisting and adopt the first tilting for setting the target direction.

9. The ship control device according to claim 1, wherein the processing circuitry is further configured to set a change rate of the target direction based on amount of the first tilting or an amount of the twisting.

10. The ship control device according to claim 9, wherein the processing circuitry is further configured to set the change rate of the target direction as a discrete value.

11. The ship control device according to claim 1, wherein the processing circuitry is further configured to stop the automatic navigation control mode and switches to the manual operation control mode when the second tilting of the shaft of the joystick in the bow direction or the stern direction is within a cancel range of the automatic navigation control mode, or when an operating speed of the first tilting or second tilting exceeds a predetermined speed.

12. The ship control device according to claim 1, wherein the first operator is further configured to acquire an operation input for enabling an intermittent throttle control, and wherein the processing circuitry is further configured to generate an intermittent throttle signal having a High level and a Low level when the intermittent throttle control is enabled.

13. The ship control device according to claim 12, wherein the first operator is further configured to acquire the operation input for setting the intermittent throttle control, and wherein the processing circuitry is further configured to set a duty ratio or frequency of the intermittent throttle signal based on the operation input for setting the intermittent throttle.

14. The ship control device according to claim 1, wherein the processing circuitry is further configured to set a forward throttle range and a reverse throttle range differently.

15. The ship control device according to claim 1, wherein the processing circuitry is further configured to adjust the throttle opening based on the amount of the twisting operated in a state where the second tilting is maximum.

16. A ship control method, comprising:

obtaining operation input from each of a first operator used in a low-speed navigation control mode and a second operator used in a high-speed navigation control mode, determining a target direction or a throttle opening based on the operation input, wherein the low-speed navigation control mode includes a manual operation control mode by operation of the first operator and an automatic navigation control mode for holding a heading using the target direction, or holding the throttle opening, setting the target direction or the throttle opening used for an automatic navigation based on the operation input from the first operator in the automatic navigation control mode, and automatically navigating the ship based on the operation input from the first operator, wherein the first operator is configured to comprise a joystick acquiring the operation input of a first tilting of a shaft in a port direction or a starboard direction and a twisting of a head, setting the target direction based on the first tilting or the twisting, wherein the first operator is further comprises a throttle range selection button for selecting from a plurality of candidates a throttle range which the throttle opening is set by an operation input of a second tilting of the shaft of the joystick in the bow or stern direction of the ship, and selecting and setting the throttle range from the plurality of candidates for the throttle range based on the operation input to the throttle range selection button.

17. A non-transient computer-readable recording medium, recording a ship control program, enabling a computer to:

acquire operation input from each of a first operator used in a low-speed navigation control mode and a second operator used in a high-speed navigation control mode, determine a target direction or a throttle opening based on the operation input, wherein the low-speed navigation control mode includes a manual operation control mode by operation of the first operator and an automatic navigation control mode for holding a heading using the target direction, or holding the throttle opening, set the target direction or the throttle opening used for an automatic navigation based on the operation input from the first operator in the automatic navigation control mode, and automatically navigate the ship based on the operation input from the first operator, wherein the first operator is configured to comprise a joystick acquiring the operation input of a first tilting of a shaft in a port direction or a starboard direction and a twisting of a head, set the target direction based on the first tilting or the twisting, wherein the first operator is further comprises a throttle range selection button for selecting from a plurality of candidates a throttle range which the throttle opening is set by an operation input of a second tilting of the shaft of the joystick in the bow or stern direction of the ship, and select and set the throttle range from the plurality of candidates for the throttle range based on the operation input to the throttle range selection button.

* * * * *